US006582204B2

(12) United States Patent
Gray, Jr.

(10) Patent No.: US 6,582,204 B2
(45) Date of Patent: Jun. 24, 2003

(54) FULLY-CONTROLLED, FREE-PISTON ENGINE

(75) Inventor: Charles L. Gray, Jr., Pinckney, MI (US)

(73) Assignee: The United States of America as represented by the Administrator of the U.S. Enviromental Protection Agency, Washington, DC (US)

( * ) Notice: Subject to any disclaimer, the term of this patent is extended or adjusted under 35 U.S.C. 154(b) by 0 days.

(21) Appl. No.: 09/946,824

(22) Filed: Sep. 6, 2001

(65) Prior Publication Data

US 2003/0044293 A1 Mar. 6, 2003

(51) Int. Cl.[7] ..... F04B 35/00; F04B 17/00
(52) U.S. Cl. ..... 417/364; 123/46 E
(58) Field of Search ..... 417/11, 364, 387; 123/465 L, 46 R, 46 SC, 46 E; 60/595

(56) References Cited

U.S. PATENT DOCUMENTS

| | | | | | |
|---|---|---|---|---|---|
| 4,369,021 | A | * | 1/1983 | Heintz | 417/364 |
| 4,382,748 | A | * | 5/1983 | Vanderlaan | 417/11 |
| 4,435,133 | A | * | 3/1984 | Meulendyk | 417/364 |
| 4,815,294 | A | * | 3/1989 | David | 60/595 |
| 4,876,991 | A | * | 10/1989 | Galitello, Jr. | 123/46 E |
| 5,144,917 | A | * | 9/1992 | Hammett | 123/46 SC |
| 5,246,351 | A | * | 9/1993 | Horn et al. | 417/387 |
| 5,287,827 | A | * | 2/1994 | Almendinger et al. | 123/46 R |
| 5,535,715 | A | * | 7/1996 | Mouton | 123/197.1 |
| 5,540,194 | A | * | 7/1996 | Adams | 123/46 R |
| 5,678,522 | A | * | 10/1997 | Han | 123/465 C |
| 5,775,273 | A | | 7/1998 | Beale | 123/46 |
| 6,035,637 | A | | 3/2000 | Beale et al. | 60/595 |

FOREIGN PATENT DOCUMENTS

| | | | | |
|---|---|---|---|---|
| NO | WO 97/28362 | * | 8/1997 | F02B/71/00 |
| NO | WO 97/28363 | * | 8/1997 | F02B/71/00 |

* cited by examiner

*Primary Examiner*—Teresa Walberg
*Assistant Examiner*—Leonid M Fastovsky
(74) *Attorney, Agent, or Firm*—Lorusso, Loud & Kelly

(57) ABSTRACT

A free-piston engine includes at least one dual piston assembly, each of which has a pair of axially opposed combustion cylinders and free-floating combustion pistons respectively mounted in the combustion cylinders for reciprocating linear motion responsive to successive combustions. A pumping piston extends from and is fixed to each of the combustion pistons and reciprocates within a hydraulic cylinder located between paired combustion cylinders. The paired combustion cylinders are rigidly connected by a cage for reciprocating movement in tandem.

39 Claims, 12 Drawing Sheets

FULLY-CONTROLLED, FREE-PISTON ENGINE

BACKGROUND OF THE INVENTION

1. Field of the Invention

The present invention relates to the conversion of chemical energy (fuel) into hydraulic, electric or pneumatic energy. The general field of application is the efficient production of hydraulic, electric or pneumatic power for mobile and non-mobile power needs.

2. The Prior Art

Hydraulic power is currently produced by rotating the drive shaft of a hydraulic pump by a drive motor, usually an electric motor or an internal combustion engine. Power from a rotating shaft must be converted into a linear motion to drive reciprocating pistons which serve as the pumping means for the most efficient hydraulic pumps. When a reciprocating piston pump is driven by a conventional crankshaft internal combustion engine, pistons within the engine are driven linearly by the expansion of combustion gases, which in turn are connected by rods to a crankshaft, to produce rotating power output, which in turn is connected to the drive shaft of a piston pump which must then create the linear motion of the pumping pistons to produce hydraulic power.

The idea of directly (and usually axially) coupling the engine combustion piston to the hydraulic piston to produce hydraulic power directly from the linear motion of the combustion piston, avoiding the cost and inefficiencies of converting linear motion to rotation and back to linear, is not new. However, a variety of challenges associated with prior art designs have prevented any commercial success of this basic idea.

Connecting the combustion piston to the hydraulic piston eliminates the need for an engine crankshaft, and in doing so forms a free-piston assembly. Since the piston assembly is not connected mechanically to an apparatus which could in turn be used to control thernovement of the free-piston assembly, one major challenge associated with the basic idea of free-piston engines is how to accurately and repeatably (for millions of events) control the exact position of the stoppage of the assembly as it approaches the top dead center (TDC) position of the combustion piston during its compression stroke. For a combustion engine to be efficient, the control of the degree of compression (that is the compression ratio) is critical, and the high compression ratios of efficient combustion processes result in the need to take and stop the combustion piston very near (often within 1 millimeter) the opposite end of the combustion chamber (usually the engine "head"). A similar challenge is associated with the control of the exact position of the stoppage of the assembly as it approaches the bottom dead center (BDC) position of the pumping piston during the expansion or power stroke. The friction of each stroke can vary (especially during warm-up or transient operation), the quantity of fuel provided for each combustion event can vary, the beginning of the combustion process can vary, the rate of combustion and its completeness can vary, the pressure of the hydraulic fluid being supplied to the pump can vary, the pressure of the hydraulic fluid being expelled can vary, and many other operating parameters that influence each stroke can vary; therefore, the accurate control of the TDC and BDC positions is very challenging. The consequences of inadequate control can go beyond unacceptable performance, and be destructive to the engine if the combustion piston contacts the opposite end of the combustion chamber or the pumping piston contacts the opposite end of the pumping chamber.

Free-piston engines of the prior art operate on the two stroke cycle (with one exception to be described later) because of the challenge of operational control. Even with a two stroke cycle, stoppage of the combustion piston at the correct position at TDC during the compression stroke is very difficult. If the engine were operating on the four stroke cycle, an additional TDC stroke would be required to exhaust the spent combustion gases. In this exhaust stroke, unlike the compression stroke, there would be no trapped gases to increase in pressure as the combustion piston moved toward TDC and thereby decelerate the piston assembly. Some other means would be necessary to restrain the piston assembly from impact. Additional means would also be needed to move the assembly through the two additional strokes. Other problems or disadvantages of prior art designs will be apparent as they are contrasted with the present invention.

There are several informative technical papers, Society of Automotive Engineers (SAE) papers numbers 921740, 941776, 960032 and the reference listed therein, which provide review and analysis of the various free-piston engine concepts. There are also several United States free-piston hydraulic pump and related technology patents which might be considered relevant to the present invention and are as follows:

- U.S. Pat. No. 4,087,205 Heintz: Free-Piston Engine-Pump Unit
- U.S. Pat. No. 4,369,021 Heintz: Free-Piston Engine Pump
- U.S. Pat. No. 4,410,304 Bergloff et al: Free Piston Pump
- U.S. Pat. No. 4,435,133 Meulendyk: Free Piston Engine Pump with Energy Rate Smoothing
- U.S. Pat. No. 3,841,707 Fitzgerald: Power Units
- U.S. Pat. No. 6,152,091 Bailey et al: Method of Operating a Free Piston Internal Combustion Engine
- U.S. Pat. No. 5,983,638 Achten et al: Hydraulic Switching Valve, and a Free Piston Engine Provided Therewith
- U.S. Pat. No. 5,829,393 Achten et al: Free Piston Engine
- U.S. Pat. No. 4,891,941 Heintz: Free-Piston Engine-Pump Propulsion System
- U.S. Pat. No. 4,791,786 Stuyvenberg: Free-Piston Motor with Hydraulic or Pneumatic Energy Transmission
- U.S. Pat. No. 4,382,748 Vanderlaan: Opposed Piston Type Free Piston Engine Pump Unit
- U.S. Pat. No. 6,029,616 Mayne et al: Free Piston Engine
- U.S. Pat. No. 5,556,262 Achten et al: Free Piston Engine Having a Fluid Energy Unit
- U.S. Pat. No. 5,363,651 Knight: Free Piston Internal Combustion Engine
- U.S. Pat. No. 5,261,797 Christenson: Internal Combustion Engine/Fluid Pump Combination
- U.S. Pat. No. 4,415,313 Bouthors et al: Hydraulic Generator with Free Piston Engine There is also a free-piston, hydraulic-pump engine, which can operate in either the two stroke or four stroke cycles, disclosed in U.S. Pat. No. 5,611,300 (FIGS. 6–8 and claims 11–12). This engine utilizes a conventional crankshaft and combustion piston to intake and compress air and to exhaust the spent combustion gases for the four stroke cycle.

Free-piston engines of prior art design are generally classified as single piston, opposed piston or dual piston. The present invention would be classified as a dual piston configuration. Like prior art free-piston engines, the present invention utilizes the stroke of the combustion piston to directly produce hydraulic, pneumatic or electric energy. However, for ease of description of the essential features of the present invention, only hydraulic energy production will be described.

Additional challenges associated with the various prior art free-piston engine designs include:

(1) Difficulty in achieving mechanical balance. Each stroke of a free-piston assembly transmits an acceleration and a deceleration force to the engine housing, and to the structure to which the engine is mounted unless these forces are somehow counteracted (i.e., balanced) within the engine. Proponents of opposed piston engines usually stress as a primary advantage the potential for good balance, but the difficulty of exactly controlling the movement of each free-piston makes this potential difficult to realize in practice.

(2) Accurate control of timing and quantity of fuel introduction. This challenge is primarily related to control of the piston assembly motion as previously discussed, but the elimination of this sensitivity would be highly beneficial.

(3) Operation utilizing two stroke cycle. There are currently no two stroke cycle automotive engines sold in the United States. This is because it is extremely difficult to control air pollution exhaust emissions from such engines. This challenge would apply to two stroke cycle free-piston engines as well.

(4) Difficulty of providing a wide range of power output. A natural frequency (similar to a mass-spring-damper system) exists for any type of free-piston engine, and it is difficult to significantly vary this speed. This natural frequency is influenced most by the mass of the piston assembly and the stroke length. Smaller values for mass and stroke increase the frequency but greatly increases the velocity especially during the early part of the expansion or power stroke. The increased velocity in this region inhibits complete combustion and reduces the hydraulic efficiency of the pumping piston. In an attempt to increase frequency and thereby specific power, most prior art free-piston engines strive to minimize mass and thus incur combustion and efficiency penalties. To vary power output they teach intermittent operation. Operation can pause after each cycle so varying the pause time will vary the average power output. However, the time for each cycle was fixed by the high natural frequency, and the engine continues to experience the efficiency penalties previously mentioned.

(5) Difficulty of responding to varying high pressure levels. Most hydraulic systems where free-piston engines would be attractive experience a wide range in system high pressure levels, e.g., from 2000 to 5000 psi. Many free-piston engine designs would operate with a fixed high pressure and thus have limited applicability. Others would require changing the fuel supply level to correspond to changing pressures. For example, at 5000 psi the engine fuel consumption level (per cycle) would be maximum and proportionally lower at lower pressures. One obvious problem with this approach is that the hydraulic power output drops with pressure, e.g. at 2500 psi only one half the maximum power output could be supplied. Also, there is usually a need for increased (not decreased) power if the system pressure drops. Others have suggested using a well known pumping flow "Bypass system" (Beachley and Fronczak in SAE paper 921740) or by another name "coupling a hydraulic accumulator with said pressure chamber at a selected point in time during said return stroke to thereby attain said output operating pressure" (U.S. Pat. No. 6,152,091) or by another name "adjustment of the effective piston stroke" (U.S. Pat. No. 6,814,405, Octrooiraad Nederland). The size of the hydraulic pumping chamber is such that even at the lowest expected pressure (e.g., 2000 psi), the maximum combustion energy can be delivered as hydraulic flow through no more than the full stroke of the pumping piston. At higher pressures, a valve would bypass the initial flow back to the low pressure system, shutting that valve at a position in the power stroke where the remaining stroke is needed to transfer the full combustion energy to the high pressure hydraulic system. Theoretically, this approach would allow the engine to run at an optimum condition independent of system high pressure level. The bypass flow system has been used in several commercial, non free-piston engine hydraulic systems such as diesel engine fuel injection pumps and certain variable displacement "check valve" hydraulic pumps (e.g., Dynex pumps). For example, in diesel engine fuel injection pumps, a piston chamber is charged (much like the method of the piston chamber of free-piston engines), through a check valve with low pressure diesel oil from the fuel tank, as the piston moves from TDC to BDC within the piston chamber. Then, as the piston returns from BDC toward TDC, a "spill valve" allows fuel to bypass the high-pressure check valve outlet to the injector and return to the tank. Depending on the torque command (i.e., the fuel quantity needed for injection), the bypass valve will shut at the appropriate stroke position to deliver the needed fuel through the high pressure check valve to the injector. The reason that this approach to "varying the effective stroke of the pumping piston" has not yet been commercially successful in free-piston engines is because it results in an unacceptable efficiency loss. For the free-piston engine, the bypass flow rate is the highest flow rate in the cycle. This is because there is little resistance to the flow and the velocity of the piston is at maximum since the expansion of the combustion gases has accelerated the reciprocating mass to its maximum speed. After the bypass is shut, the pumping work decelerates the assembly. To provide "little resistance" to this high flow rate, the bypass valve must be very large. If the valve is too small, the flow pressure losses will waste potential hydraulic power and greatly reduce efficiency. A large bypass valve on the other hand has a larger relative mass and, for a given closing force, will shut much slower. During the closing period the high flow rate experiences an increasing pressure drop and wastes potential hydraulic power. Existing systems utilizing this approach experience such losses. For the diesel engine fuel injection example, the power associated with the flow rate of the diesel fuel is so low relative to the power output of the diesel engine (or relative to the power associated with the flow rate for a comparable power free-piston engine) that some losses in efficiency have a relatively small impact on the diesel engine efficiency, although still significant and the subject of much research. Likewise, variable displacement check-valve hydraulic pumps are significantly less efficient than other approaches to varying displacement in hydraulic pumps, but because of their simplicity and relatively low cost, they have found some commercial success. For a free-piston engine to be successful in utilizing a bypass valve approach, it must operate with minimal open flow losses, be able to accurately and repeatably shut on command, and most importantly, must be extremely fast.

Prior art dual piston configurations of free-piston engines contain a pair of opposed power pistons which are fixedly, internally interconnected. Each power (combustion) piston has a hydraulic pumping piston axially attached through a connecting rod. FIG. 1 shows the free-piston assembly of prior art dual piston configurations. Opposed combustion pistons 2 and 3 slide within combustion cylinders (not shown). Combustion pistons 2 and 3 respectively have inwardly attached pumping pistons 4 and 5 which slide within pumping cylinders 6 and 7. The pumping pistons 4 and 5 are fixedly and internally connected through sealing block 8 by connecting rod 9, whereby combustion pistons 2 and 3 and pumping pistons 4 and 5 and connecting rod 9 reciprocate as a unit. Coaxially and therefore internally connecting a pair of single unit free-piston assemblies to form a dual piston assembly presents several problems:

(1) The free-piston assembly is longer than would otherwise be necessary by the length of sealing block 8.

(2) A high pressure hydraulic fluid seal (or pair of seals) must be provided within the sealing block 8 which adds cost and imposes increased friction which significantly reduces overall efficiency. Any seal leakage also reduces overall efficiency.

(3) Two sets of three concentric and coaxial cylinders/bores are extremely difficult to fabricate with tight tolerances. Also, the manufacturing of two sets of three concentric and coaxial pistons/rods to tight tolerances is quite difficult. Further, minimizing the stack-up of tolerances when the piston assembly must reciprocate within the nest of cylinders without binding on the one hand and without high leakage due to the large clearances on the other hand, is extremely challenging.

(4) The pumping pistons must be larger in diameter to maintain a needed piston pumping area than would be necessary without the connecting rod. The larger diameter pumping pistons produce higher friction and higher leakage. The diameter of the connecting rod must be relatively large since it must transmit the forces necessary to accelerate and decelerate the opposite side single free-piston assembly mass, which translates into an even larger increase in the pumping piston diameter.

(5) The structure of the assembly is not sufficiently rigid to allow acceptable ringless combustion, as will be further addressed later.

(6) The dual piston assembly is not mechanically balanced.

SUMMARY OF THE INVENTION

Accordingly, it is an objective of the present invention to provide for stoppage of a combustion piston and pumping piston in a free-piston engine at positions providing an appropriate top dead center position of the combustion piston.

Another objective of the present invention is to provide a free-piston engine which can be practically operated in a four-stroke cycle.

Yet another objective of the present invention is to provide a free-piston engine which is mechanically balanced.

Still another objective of the present invention is to provide a free-piston engine which is mass balanced.

Yet another objective of the present invention is to provide a free-piston engine which can be operated for a wide range of target compression ratios.

Still another objective of the present invention is to provide a free-piston engine assembly which is sufficiently rigid to allow for acceptable ringless combustion.

In order to achieve the foregoing objectives, in one aspect the present invention provides a free-piston engine including at least one dual piston assembly having a pair of axially opposed combustion cylinders and a free-floating combustion piston contained in each of the combustion cylinders for reciprocating linear motion responsive to combustion within the combustion cylinder. At least one pumping piston extends from and is fixed to each of the combustion pistons and each pumping piston is received within a hydraulic cylinder which is fixed in position between the paired combustion cylinders. A cage structure rigidly connects combustion pistons and surrounds the hydraulic cylinders and pumping pistons. As in conventional designs, ports in each of the hydraulic cylinders admit fluid at a first pressure and discharge fluid at a pressure higher than the inlet.

The hydraulic cylinders may be rigidly connected and the combustion pistons are rigidly connected by the cage structure so that when one of the combustion pistons is at top dead center, the other combustion piston is at bottom dead center.

The engine of the present invention may further include a bushing surrounding and guiding a rod interposed between and connecting a combustion piston with a pumping piston in order to allow for use of a ringless combustion piston.

The engine of the present invention is computer controlled with provision of position indicators on each cage connecting paired pistons, position sensors for reading the position indicators and an electronic control unit (ECU) for determining position of the cage, velocity, acceleration, et cetera and for controlling associated valving to stop movement of the dual piston assembly at TDC and BDC positions providing a target compression ratio.

In one preferred embodiment the engine of the present invention includes at least two of the dual piston assemblies and a synchronizer connecting the cages for synchronized parallel movement of the dual piston assemblies in opposite directions. The synchronizer can be the combination of a rack on each of the cages and a pinion located between and engaged by the racks, a chain/sprocket assembly or other similar means.

In another aspect, the present invention provides a method of operating a free-piston engine having at least one dual piston assembly as described above. The method involves drawing a fluid at low pressure through a low pressure fluid intake valve, into the hydraulic cylinders as the pumping pistons travel from BDC to TDC and discharging the fluid at a higher pressure, as the pumping pistons travel from TDC to BDC. Position indicators on the piston assembly are read to generate position signals and, on the basis of those position signals, the ECU determines a stoppage position for the dual piston assembly which provides a target compression ratio. The ECU generates a command signal for closing the low pressure fluid intake valve in the current cycle, to cause the dual piston assembly to stop at the determined stoppage position and to thereby achieve the target compression ratio in real time. The stoppage position is determined to allow the low pressure fluid intake valve to remain open through completion of filling fluid of a hydraulic cylinder and to close the low pressure fluid valve during discharge back to low pressure, generally of between 20% and 100% (idle) of the filled volume of the hydraulic cylinder, depending primarily on engine load and system high pressure. In determining the command signal for closing the intake valve, the ECU may also utilize signals representing the low (inlet) and high (outlet) pressures of one or more hydraulic cylinders. One approach to determination of a target position for closing the intake valve involves determination of energy produced by a single combustion event in a given cycle, as a function of velocity and acceleration of a dual piston assembly.

Preferably, the method of the present invention further includes a failsafe feature in which a range of closing positions for the low pressure fluid intake valve is determined on the basis of engine operating parameters such as fuel supply rate and the high (outlet) pressure of one or more hydraulic cylinders. In this preferred embodiment, the engine is shut off when the detected stoppage position is outside the established range for stoppage position.

The free-piston of the present invention further includes at least one fluid intake valve for controlling the emission of fluid into one of the hydraulic cylinders. In a preferred embodiment, that fluid intake valve is the fast acting valve disclosed in applicants' prior U.S. Pat. No. 6,170,524, the teachings of which are incorporated herein by reference. In another preferred embodiment the fluid intake includes a valve member having a cupped head with a peripheral sealing surface and opposing concave and convex surfaces, and an integral guide stem extending from the convex surface. This preferred embodiment of the intake valve further includes a guide member with an axial bore receiving the guide stem of the valve member and providing for axial reciprocating movement of the guide member relative thereto between open and closed positions. A spring is included for biasing the valve member toward the closed position where the sealing surface of the head seals against a valve seat. The valve seat surrounds an axially extending port in fluid communication with one of the hydraulic cylinders. A reciprocal pin is mounted coaxially within the port for reciprocating movement between a retracted position and an extended position wherein the pin is in contact with the concave surface of the cupped head and holds the valve member in the open position. This preferred valve structure further includes an outlet port which may optionally be connected to a fluid accumulator which, in turn, may include a gas-filled bladder. A fluid connector connects TDC space within one cylinder with the axial bore of the guide member so that, as fluid pressure within the one cylinder is increased as the pumping piston therein approaches top dead center, the increased pressure operates on the guide stem to force the valve member into its closed position.

In another preferred embodiment, the free-piston engine of the present invention further includes impact pads mounted on the cage (5) for limiting movement of the dual piston assembly into the combustion cylinders.

Optionally, the dual piston assembly may further include balancing members mounted on opposing sides of and geared to the dual piston assembly for reciprocating motion in a direction opposite to the direction of motion of the dual piston assembly.

In yet another embodiment the free-piston engine of the present invention includes four parallel, side-by-side combustion cylinders, each having a free-floating combustion piston mounted therein for reciprocating linear motion, responsive to successive combustions within the combustion cylinders. As in the previously described embodiments, at least one pumping piston extends from and is fixed to each of the combustion pistons and a hydraulic cylinder is provided for receiving each of the pumping pistons. In this preferred embodiment a shuttle cylinder is axially aligned with and is in fluid communication with each of the hydraulic cylinders. A shuttle piston is mounted in each shuttle cylinder for reciprocating motion therein. Connectors rigidly and axially connect a shuttle piston to each of the pumping pistons. Transfer tubes provide fluid communication between first and second shuttle cylinders and between third and fourth shuttle cylinders. Flexible linkages are arranged within and run through the respective transfer tubes and are connected to the shuttle pistons of the first and second shuttle cylinders and the shuttle pistons of the third and fourth shuttle cylinders, respectively. A linkage connects the shuttle pistons in the second and third shuttle cylinders for movement together in tandem along with their associated pumping pistons and combustion pistons.

In still another preferred embodiment of the present invention, four of the dual piston assemblies are axially paired with one pair of dual piston assemblies in parallel with the other pair of dual piston assemblies. This embodiment further includes an outer cage rigidly affixed to one of the cages in the axially paired dual piston assemblies. A synchronizer, similar to that mentioned above, connects the two outer cages for synchronized movement in opposite directions. As is the case of the synchronizer described in connection with other embodiments, this synchronizer may include a rack on each of the outer cages and a pinion arranged between and engaged by each of the racks.

DESCRIPTION OF THE PREFERRED EMBODIMENTS

This invention will be described with reference to preferred embodiments having a dual piston, hydraulic-pump configuration. Many of the unique features (e.g., methods of operation, valve designs and accumulator designs) of the present invention are also applicable to single piston and opposed piston configurations, as one skilled in the art can readily see. Like prior art free-piston engine designs, the present invention utilizes the stroke of the combustion piston to directly produce hydraulic power.

The preferred embodiments are characterized by two non-axially attached single piston assemblies in opposed cylinders (herein also referred to as a dual piston assembly). Whenever one of the pistons is at TDC the other piston is at BDC. The energy needed for the compression stroke of one combustion piston is provided by the expansion stroke of the other combustion piston, at least for the two stroke cycle.

The present invention operates in the two stroke cycle when embodied with a single dual piston assembly. However, the present invention can operate in either the two stroke cycle or the four stroke cycle when embodied with a pair (or more) of dual piston assemblies, as will be further described later. The combustion system can utilize all the various embodiments of conventional two stroke and four stroke cycle engines as applicable, and such features will not be described here except to the extent that the present invention provides a unique means of performing a particular function not known in prior art free-piston engines or where such description could enhance the understanding of the present invention.

Figure 1:
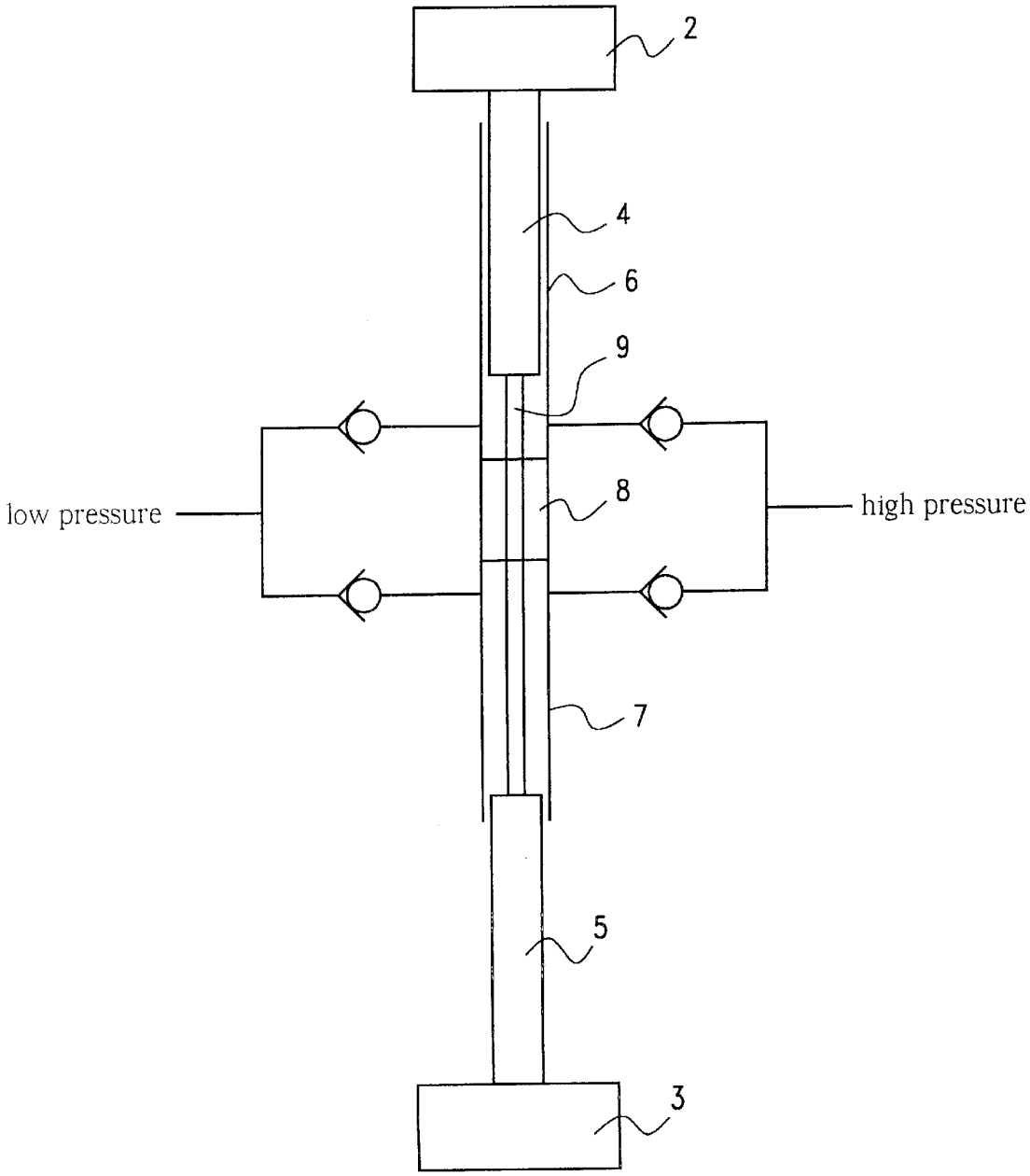
FIG. 1 (Prior Art)
FIG. 1 is a schematic view illustrating a conventional dual piston, free-piston engine.
Figure 3:
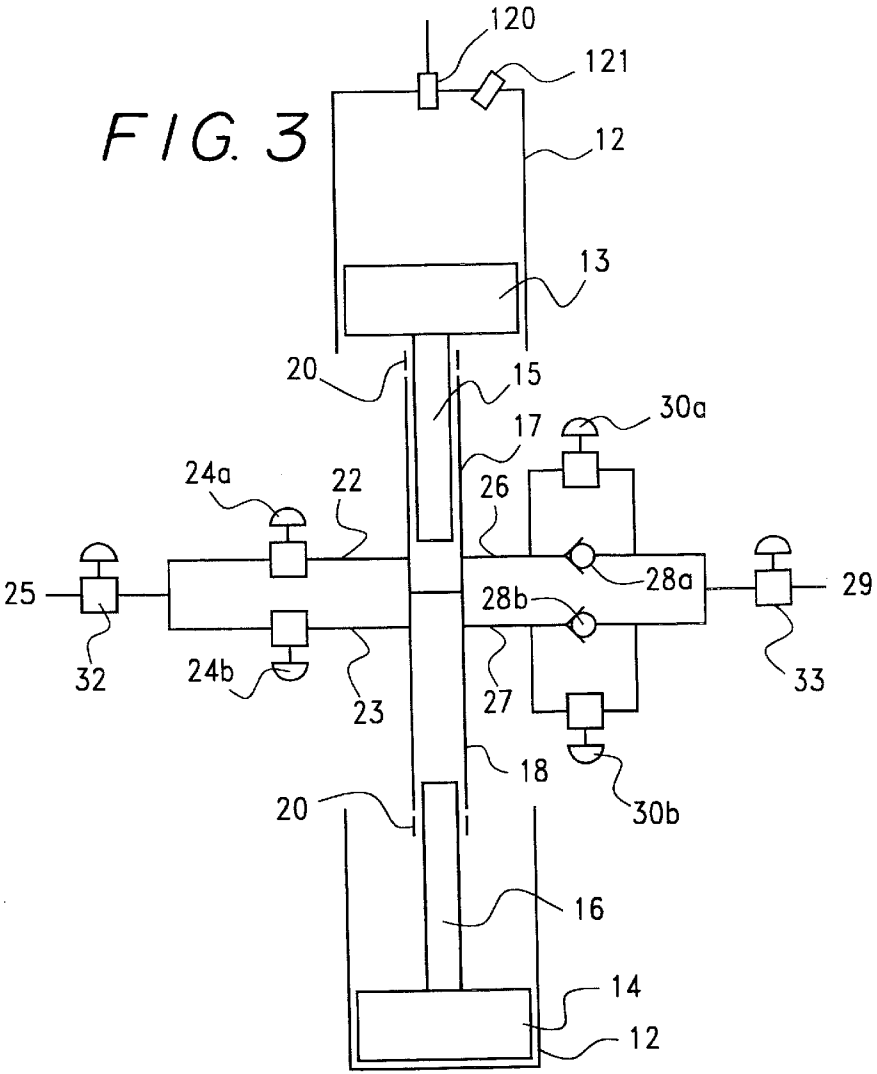
FIG. 3 is another view of the dual piston assembly of FIG. 2, further showing the fluid circulation system associated therewith.
Figure 2:
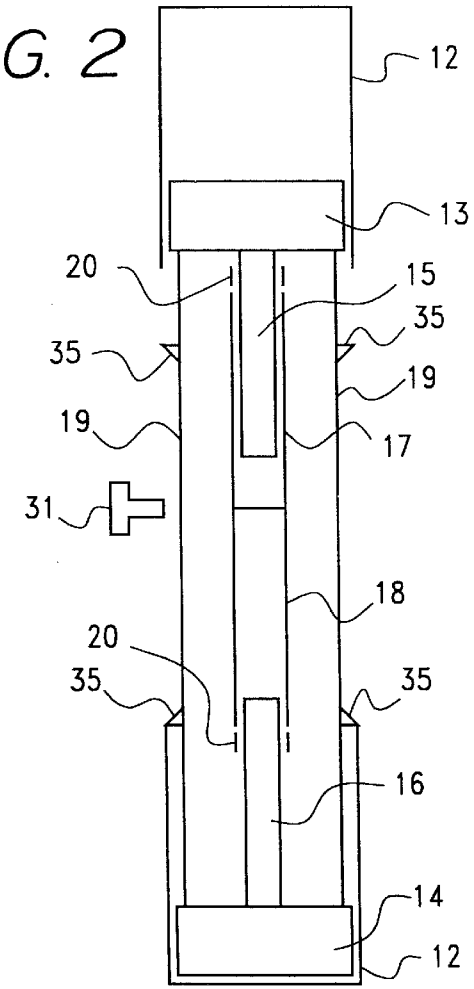
FIG. 2 is a schematic view of a single dual piston assembly in one embodiment of the free-piston engine of the present invention.

FIGS. 2 and 3 show cross sectional views (in perpendicular planes) of a preferred embodiment utilizing a single dual piston assembly included in a free piston engine unit. Cylinders 12 are part of the engine structure (not further shown). An igniter 120 and a fuel injector 121 are illustrated but, intake and exhaust valves/ports and other conventional features of internal-combustion two stroke and four stroke cycle engines, while present, are not shown. Opposed combustion pistons 13 and 14 slide within cylinders 12. Combustion pistons 13 and 14 respectively have axially and inwardly attached pumping pistons 15 and 16 which slide within pumping cylinders 17 and 18. Single free-piston assembly of combustion piston 13 and pumping piston 15 and single free-piston assembly of combustion piston 14 and pumping piston 16 are attached by a rigid means external to the pumping pistons.

Figure 4:
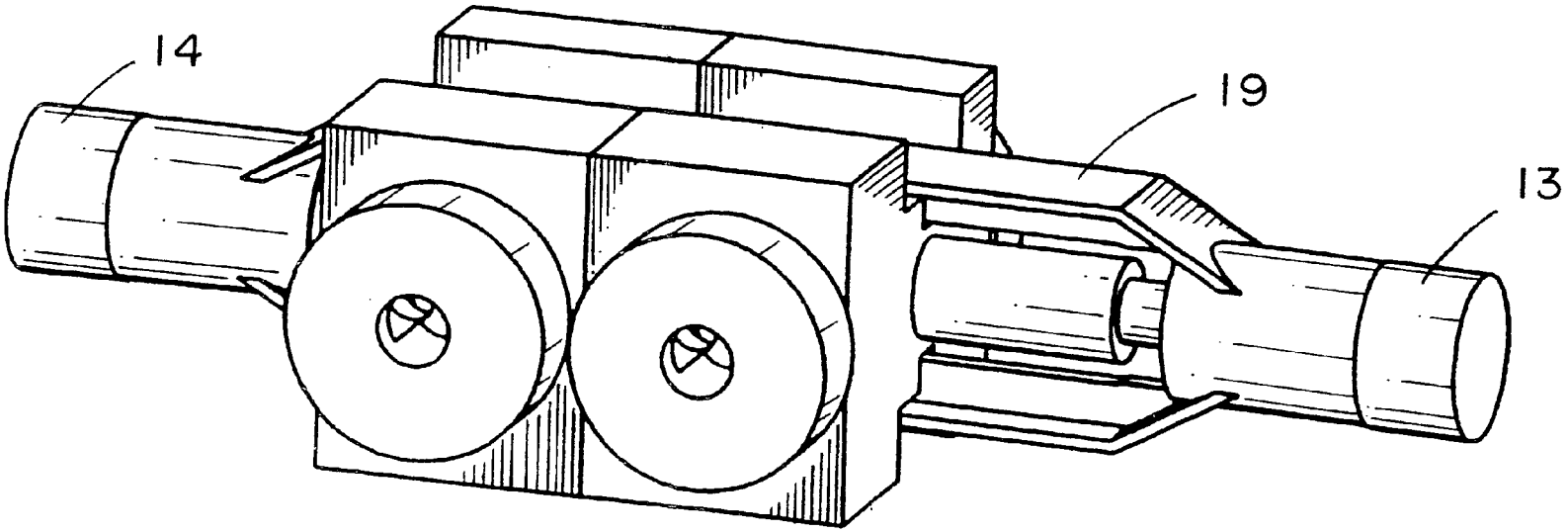
FIG. 4 is a perspective view of a dual piston assembly in accordance with the embodiment of FIG. 2.

FIG. 2 shows a cage 19 for so connecting the two single free-piston assemblies to form a dual piston assembly which reciprocates as a single unit comprising combustion pistons 13 and 14 and pumping pistons 15 and 16 and cage 19. A free-piston engine unit includes one such dual piston assembly plus the associated combustion and hydraulic cylinders. Utilizing a means external to the pumping pistons, e.g. cage 19, to rigidly attach the two separate single free-piston assemblies to form a unique configuration of a dual piston assembly, avoids the problems of prior art dual piston assemblies as previously described. FIG. 4 shows a configuration of the present invention dual piston assembly in perspective to assist in visualizing the cage structure. In this configuration the cage 19 is extended (or "bowed") out beyond the diameter of the combustion pistons 13 and 14.

Cage 19 provides for a rigid structure to avoid bending of the assembly that would occur with prior art designs, associated with the large acceleration and deceleration forces that occur with each stroke. A rigid structure and optional bushings 20 (FIG. 2) provide for accurate positioning and close clearances of combustion pistons 13 and 14 and cylinders 12 so that operation with low friction, ringless combustion pistons is feasible. The potential for ringless operation with free-piston engine designs which employ moment balanced axially pumping piston(s) (as with the present invention) is often discussed in prior art, but has not been achieved in practice. It is well known that such designs have this potential since the fundamental design eliminates the primary combustion piston side forces associated with all prior art piston/crankshaft engines that convert the piston's linear motion into the crankshaft's rotating motion. However, any secondary side forces on the combustion piston must be reacted without allowing the ringless combustion piston to contact the combustion cylinder (as ringless combustion pistons do not employ oil lubrication). Even gravity acts on the mass of the assembly to apply side forces to the piston. The present invention achieves the potential of ringless operation by utilizing bushings 20 to react against any secondary combustion piston side forces and by utilizing a rigid structure to avoid bending of the structure which would otherwise allow piston side movement.

The cage 19 structure also conveniently provides additional mass which reduces the dual piston assembly peak velocity so that optimum hydraulic pumping efficiency and reduced flow losses during pumping bypass flow stoppage, can be obtained. Since it is an object of the present invention to maximize the efficiency of producing hydraulic power, a larger mass of the reciprocating dual piston assembly is desirable, as compared to prior art which strives to reduce mass to increase velocity and frequency (which is one means of improving specific power). Further, a larger mass will facilitate practical and efficient operation utilizing homogeneous-charge, compression-ignition combustion.

FIG. 3 is a cross-sectional view of the assembly of FIG. 2 rotated 90 degrees. Pumping cylinders 17 and 18 respectively communicate with passages 22 and 23 which contain unique valves 24*a* and 24*b* (which will be described in detail later), which further connect with passage 25 through valve 32, which is further connected to the low pressure hydraulic fluid source (not shown). Plumping cylinders 17 and 18 respectively also communicate with passages 26 and 27 which have unique one-way check valves 28*a* and 28*b* (which will be described in detail later), which further connect with passage 29 (through optional valve 33) in communication with a high pressure hydraulic fluid receptor (not shown). On/off valves 30*a* and 30*b* are used to provide high pressure fluid to pumping cylinders 17 and 18 for starting the engine.

The single dual piston assembly of FIGS. 2 and 3 operates according to the two-stroke cycle. The unique method of operation of the present invention will now be described. To start the engine, the dual piston assembly will be in the position as shown on FIGS. 2 and 3. (Valve 30*b* is an optional valve to provide more flexibility in starting the engine from different initial positions.) Valve 30*a* is commanded to open and high pressure fluid flows through open optional valve 33 from passage 29, through valve 30*a*, through passage 26, and into pumping cylinder 17. High pressure fluid within cylinder 17 acts on the cross sectional area of pumping piston 15, producing a force which accelerates the dual piston assembly and combustion piston 13 toward TDC. A position sensor 31 (FIG. 2) reads position indicators (not shown) located on cage 19. Signals from position sensor 31 are sent to an electronic control unit (ECU, not shown), where the position, velocity and acceleration of the dual piston assembly are determined. The velocity is determined from the time between position indicators of known distance separation, and the acceleration (or deceleration) is determined by the rate of change of velocity. The control system provides for real time control of the dual piston assembly. The ECU includes a memory containing a characterization map of the functioning of the engine under various operating conditions. From inputs of temperature sensors for the hydraulic oil and engine structure (not shown), and the instantaneous velocity and acceleration at each position of the dual piston assembly from position sensor 31, the ECU determines the position where it commands valve 30*a* to shut-off so as to achieve a specified compression ratio of the combustion gas above piston 13. Thus, the method of control of the present invention is able to provide a desired compression ratio for the engine start-up. Since it is an object of the present invention to provide for start-up combustion on the first stroke, the initial compression ratio will be chosen to be higher than the normal operating compression ratio (also controlled on a real time basis as will be described later) so as to assure combustion. After valve 30*a* has been commanded to shut-off, the inertia of the dual piston assembly will continue to increase the volume in the pumping cylinder 17, and valve 24*a* will open in a check-valve manner (or on command) permitting low pressure fluid to flow through open valve 32 from passage 25, through valve 24*a*, through passage 22 and into cylinder 17, until piston 13 reaches TDC and combustion occurs. During the start-up stroke, valve 24*b* is commanded open (and valve 30*b* if present, is commanded shut). This allows fluid in cylinder 18 to be displaced through passage 23, through valve 24*b*, through valve 32 and through passage 25, avoiding resistance to the stait-up compression stroke.

Upon combustion, piston 13 and the dual piston assembly will begin its movement from TDC to BDC. Valve 24*a* will remain open and fluid will flow from cylinder 17, through passage 22, through valve 24*a*, through valve 32 and through passage 25, as the dual piston assembly is accelerated by the force of the combustion gases on the cross sectional area of piston 13. In a like manner as with the start-up stroke, position sensor 31 reads position indicators located on cage 19. Signals from position sensor 31 are sent to the ECU, and the velocity and acceleration of the dual piston assembly are determined at each position as it moves from TDC toward BDC. The control system continues to provide real time control of the dual piston assembly. From an appropriate characterization map and the input signals previously described, plus inputs from pressure sensors in the low pressure and high pressure lines (not shown), the ECU determines the position where it commands valve 24*a* to shut-off, so as to achieve (1) fluid flow under pressure from cylinder 17, through check valve 28*a*, through optional valve 33, and to passage 29 thus producing hydraulic power output, and (2) a specified compression ratio of the combustion gas above piston 14. The compression ratio will usually be within a range of 15 to 25. While flow from cylinder 17 proceeds as just described during the TDC to BDC stroke, flow of fluid into cylinder 18 must also occur. As the dual piston assembly begins its movement from piston 13 TDC to BDC, valve 24*b* remains open allowing a complete filling of cylinder 18 at dual piston assembly BDC. The cycle then repeats in a like manner for the next stroke with pumping piston 16 producing the hydraulic power.

The ECU determines real time the available energy produced from each combustion event from the velocity of the dual piston assembly mass and the forces still being applied to it (determined by the acceleration) at each position (whatever the fuel quantity supplied or the timing or quality of combustion),considers the frictional energy consumption from characterization maps, and determines the power stroke of the pumping piston needed (considering hydraulic system high and low pressures) to achieve a dual piston assembly stoppage position so that the compressing combustion piston achieves the real time specified compression ratio for the next combustion event. The ECU then commands the fluid intake valve (valve 24*a* or 24*b* as appropriate) to close at that position necessary to achieve the needed pumping piston power stroke.

This unique method of operation of free-piston engines to control power output based on the instant characteristics of each power stroke (including automatically adjusting for varying high and low hydraulic pressures, system friction, quantity of fuel provided for each combustion event, the boost pressure of the charge air, the beginning and rate of the combustion, and the completeness of combustion) eliminates the control challenges and problems of prior art designs. A key feature is the accurate, late closing of the fluid intake valves (24*a* and 24*b*) so that an appropriate amount of the fluid is discharged back to low pressure before the power extraction process begins, i.e., beginning of fluid discharge to high pressure. An appropriate amount to be discharged back to low pressure before closing of valve 24*a* (or 24*b*) will typically be 20% to 100% (at idle) of the volume of the hydraulic cylinder 17 (or 18), depending primarily on the engine load and system high pressure. (After a fluid intake stroke is completed, valve 24*a* or 24*b* as appropriate functions as a pumping bypass flow control valve.)

To shut-off the engine, fuel supply to the air compressed in the combustion chamber of combustion piston 14 is stopped, a full power stroke is removed from cylinder 17, and valve 24*b* is closed at dual piston assembly BDC. The air intake valve (not shown) for combustion piston 14 may also be left open during this stroke to allow more hydraulic power extraction. If available, valve 33 may be closed at assembly BDC to further fix the assembly at BDC.

Unique "failure mode" control logic is also employed in the engine method of operation. The timing of the late closing of the fluid intake valves in critical, therefore, an "open loop" table of valve closing positions as a fi.inction of the important input features such as expected friction, fuel supplied and hydraulic system high pressure are compared to those closing positions determined by the ECU real time based in part on position sensor velocity and acceleration determined values, and if the two closing positions differ beyond an acceptable range, the ECU will shut the engine down by discontinuing fuel supply and immediately closing whichever intake valve is discharging fluid. Further, if the fluid intake valve does not shut-off upon command, as determined by the next reading from the position sensor, the engine will be shut down by lack of fuel supply, by commanding the other intake valve to close and by commanding on/off supply valve 32 (FIG. 3) to close. An optional additional high pressure side on/off valve (with orifice) 33 could also be commanded to shut. Valve 33 could also be commanded shut-off if system hydraulic high pressure dropped suddenly. If the engine loses electrical power, fuel supply stops, fluid intake valves default to their closed positions, and the high fluid pressure on/off valve defaults to its closed position. If the hydraulic low pressure ever drops below specification range, fuel supply stops to shut the engine down to avoid the possibility that cavitation of the intake fluid might occur.

The present invention provides a wide range of power output without difficulty, unlike prior art free-piston engines. The power output can be reduced by either running at a lower "load level" (lower fuel rate) or by shutting down for varying time periods between periods of operation. The power output can be greatly increased by operating the engine at a high level of intake air boost pressure.

Considering the importance to overall system efficiency, the late closing intake valves (valves 24*a* and 24*b* of FIG. 3) must be large enough to have minimal open-flow pressure drop losses, be able to accurately and repeatably shut off on command, and be extremely fast in closing. Two unique valve designs of the present invention satisfy these requirements, unlike prior art designs.

Figure 5:
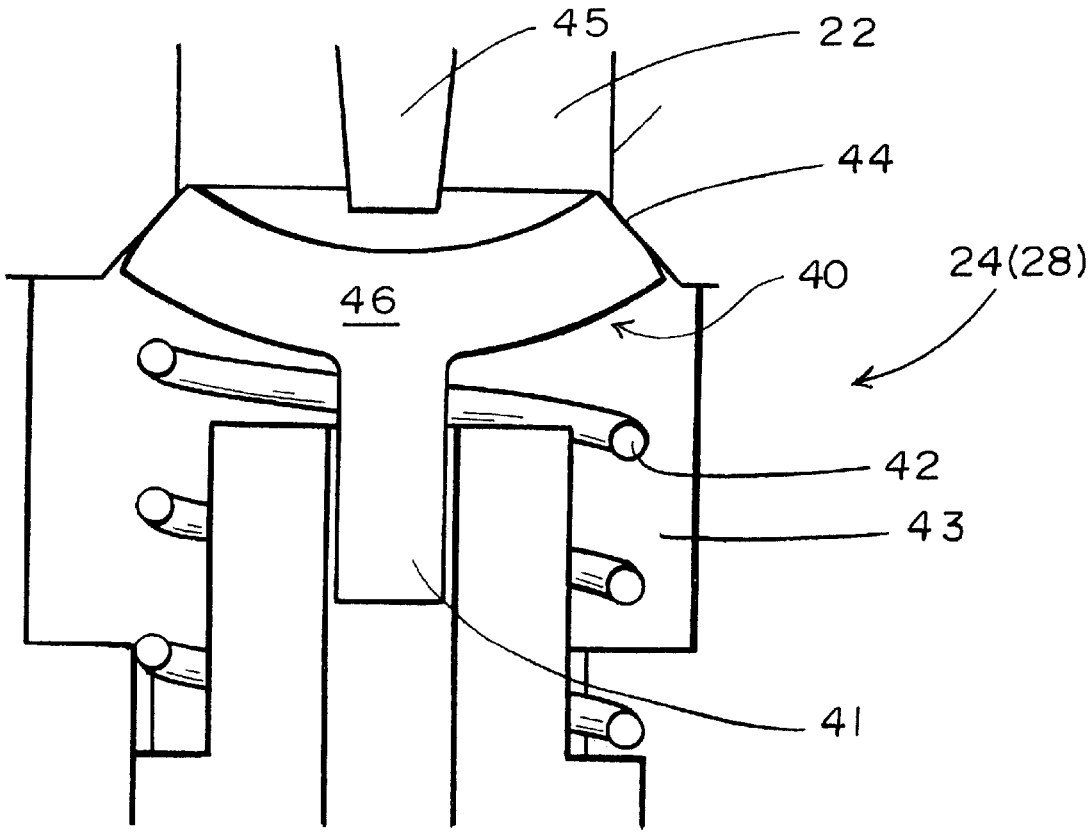
FIG. 5 is a schematic view, in section, of a preferred embodiment of an intake valve utilized in the free-piston engine of the present invention.

FIG. 5 shows a first preferred embodiment of intake valves 24*a* and 24*b*. The valve member 40 has a head 4*b* with a spherical, poppet shape (a segment of a hollow sphere) and a guide post 41 integral with head 40. This is an optimum design considering the objectives of large open flow area, rapid response and high operating pressure (e.g., 5000 psi). An intake port 22 contains low pressure fluid. Spring 42 applies force to assist shutting the valve (as shown) and to allow the valve 24 to otherwise function as a conventional check valve. Port 43 is connected to the pumping cylinder 17 (not shown on FIG. 5). When the pumping piston intake stoke begins, the pressure in the pumping cylinder and port 43 drops, and the higher pressure in port 22 opens valve 40 to allow fluid to flow through port 22, past seat 44 to port 43. Pin 45 is attached to a controllable actuator (not shown) which is commanded to apply force to valve member 40 to assist in a rapid opening. Pin 45 remains in a down, "contact-with-valve 40" position to hold valve member 40 in the full open position to minimize intake flow losses. Pin 45 also remains in the full open (or "full down") position during the initial portion of the pumping piston exhaust stroke, minimizes flow losses and allows discharge of fluid back to low pressure port 22. At that pumping piston position where power extraction must begin, pin 45 is retracted from valve 40, and spring 42 and higher pressure in port 43 rapidly shut valve 40. Optionally, pin 45 may be attached to valve 40 for an even faster closing time as pin 45 is commanded to retract.

In another preferred embodiment, the intake valves 24*a* and 24*b* are the fast valve of U.S. Pat. No. 6,170,524, the teachings of which are incorporated herein by reference. The valves disclosed in U.S. Pat. No. 6,170,524 provide extremely fast opening and closing times.

The present invention also contains unique high pressure flow "controlled," check valves (valves 28*a* and 28*b* of FIG. 3) with optionally integrated unique fluid accumulators to dampen pressure pulses due to the initiation of each pumping-to-high-pressure event. High pressure pulses are undesirable because they represent efficiency losses and complicate engine control. The high pressure check valves 28*a* and 28*b*, in one preferred embodiment, have the design of FIG. 5, with an option of a weaker spring (to reduce flow losses) and a unique means to cause the check valve to shut extremely fast and before any backflow of high pressure fluid can occur at pumping piston BDC. Backflow of high pressure fluid is a significant efficiency loss.

Figure 6:
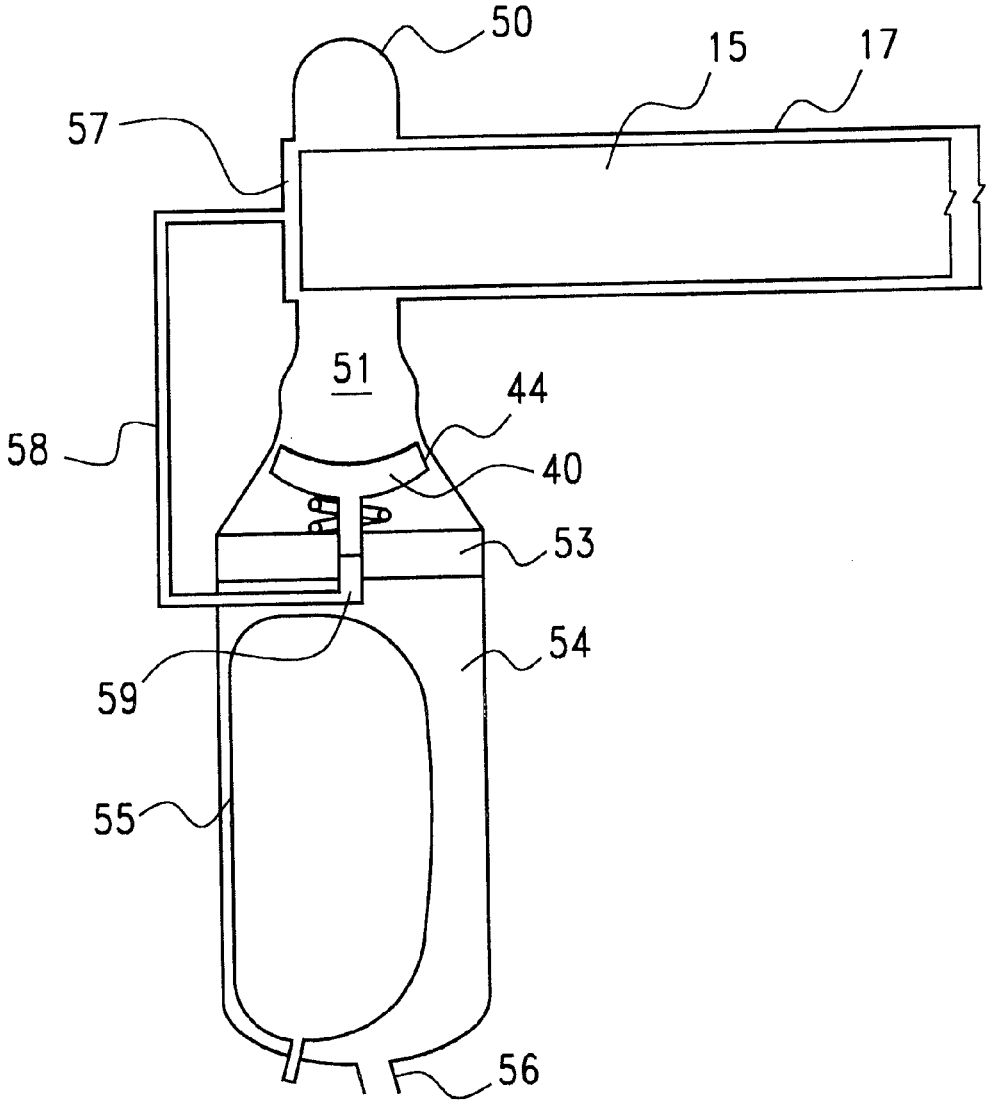
FIG. 6 is a schematic illustration of a high-pressure, fast closing check valve with associated fluid flow connections and accumulator.

FIG. 6 shows one preferred configuration of the fast closing check valves 28*a*, 28*b* integrated with an accumulator. FIG. 6 shows a portion of pumping piston 15 at its desired BDC position within a portion of pumping cylinder 17. A flow collection manifold 50 is shown ending at pumping piston 15 desired BDC position. (The intake port is not shown.) During the power producing stroke of pumping piston 15, fluid flowed from pumping cylinder 17, through manifold 50, through manifold outlet 51, past seat 44, past valve member 40, through holes (not shown) in valve post guide 53 and into the fluid volume of accumulator 54. Initial flow compressed the gas in bladder 55 reducing the initial fluid acceleration pressure spike. As flow from pumping cylinder 17 proceeded, the liquid in the lower (near the fluid exit) section of the accumulator flowed out the accumulator exit 56 to the high pressure fluid receptor (not shown). As pumping piston 15 approached its desired BDC position, the piston began shutting off the manifold outlet 51 and the pressure in chamber 57 rose rapidly, causing the pressure to rise in tube 58 and in valve shutting chamber 59. The high pressure in chamber 59 caused valve member 40 to rapidly shut, i.e., the position shown in FIG. 6, minimizing shutting flow losses and fluid back flow. This configuration also provides a hydraulic brake "back-up" for pumping piston 15 and the dual piston assembly, and a tolerance for inexactness in the pumping piston stoppage control.

Another important, unique failure-mode protection feature of the present invention is that the rigid, external attachment means for the two single piston assemblies functions as a backup stoppage means. Impact pads 35 shown on FIG. 2, are attached to cage 19 and are positioned such that if the dual piston assembly goes beyond its end-stroke, with a margin for acceptable variation (likely less than 2 or 3 tenths of a millimeter), the impact pads 35 will contact the cylinder housing 12, and thus the engine structure, providing piston-to-head impact protection.

Figure 7:
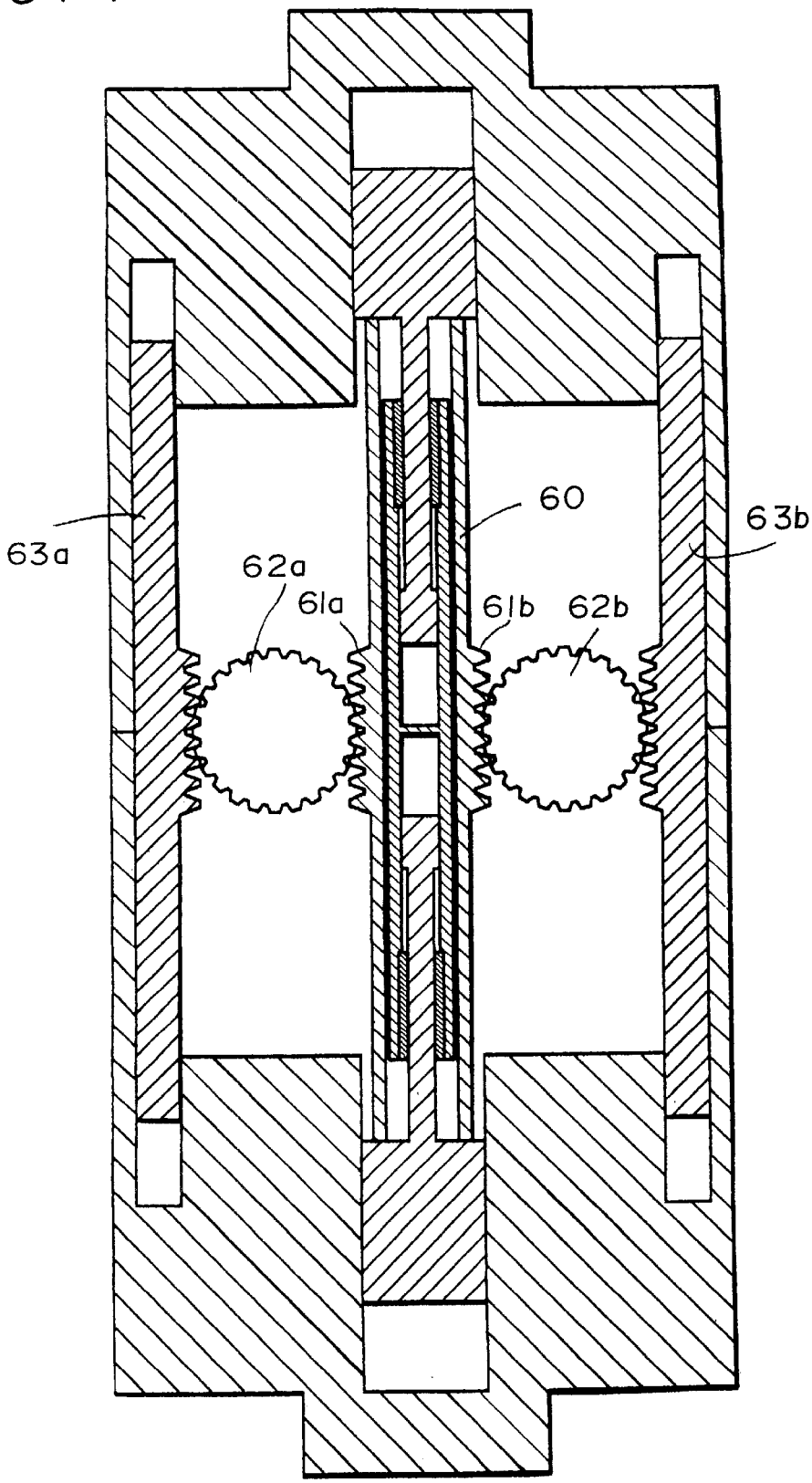
FIG. 7 is a cross-sectional view of a single dual piston assembly of a second embodiment of the engine of the present invention.

FIG. 7 shows an embodiment wherein the single dual piston assembly of FIGS. 1–6 is balanced through incorporation of a unique design. The dual piston assembly 60 is shown with gear teeth 61*a* and 61*b*, gears 62*a* and 62*b*, and, interfacing with gears 62*a* and 62*b*, balance masses 63*a* and 63*b*. Balancing masses 63*a* and 63*b* are of equal mass and each is one-half the mass of the dual piston assembly 60. As dual piston assembly 60 moves in one direction, the balancing masses 63*a* and 63*b* are driven by gears 62*a* and 62*b* to move at the same velocity in the opposite direction. In this embodiment the single dual piston assembly, free-piston engine is perfectly mass and moment balanced. The gear rack and pinion means can be replaced with a chain/sprocket, lever or other similar synchronization means.

FIGS. 8A–8D show a preferred configuration of a "four cylinder" dual piston, free-piston engine. This engine embodiment could be operated in a two-stroke cycle in which the operation of each dual piston assembly is identical to that described above for the single dual piston assembly, except for one significant distinction. The one significant exception is that the configuration of FIG. 8 is mechanically balanced without the balancing masses of FIG. 7. However, for the configuration of FIG. 8 to also be moment balanced, additional balancing masses would have to be added.

However, as illustrated in FIGS. 8A–8D, the illustrated engine can also be operated in a four-stroke cycle. FIGS.

Figure 8D:
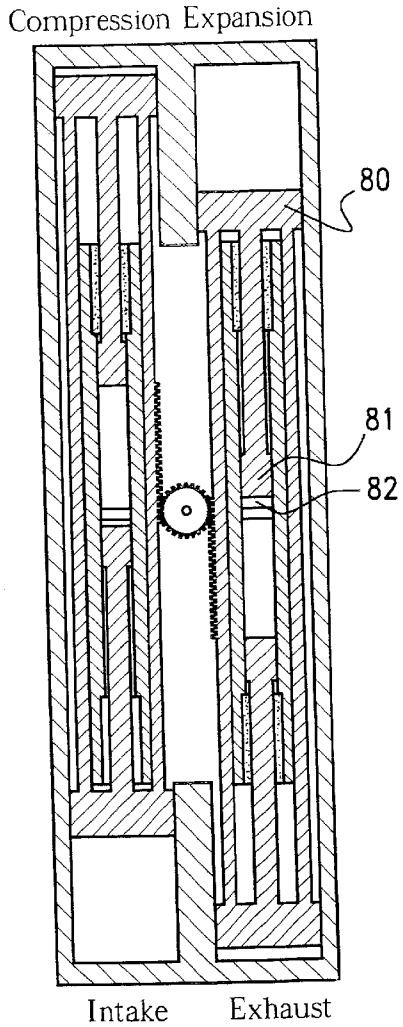
FIGS. 8A–8D show a third embodiment of the present invention having two dual piston assemblies side-by-side with gearing for synchronization of the two assemblies.
Figure 8C:
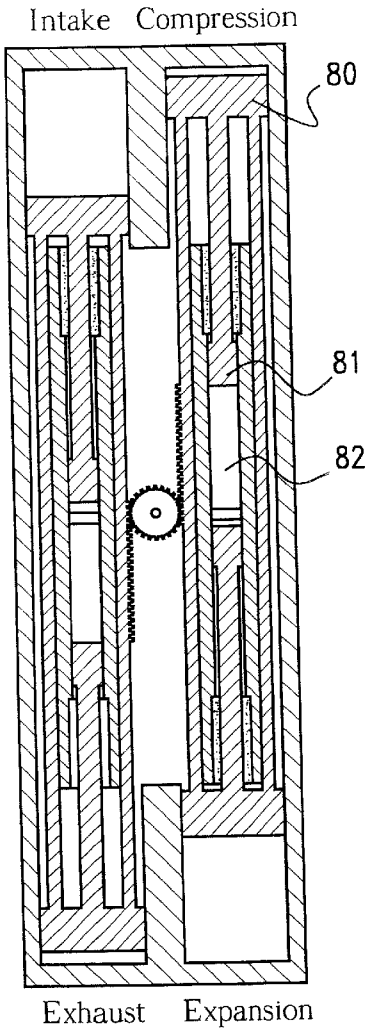
Figure 8B:
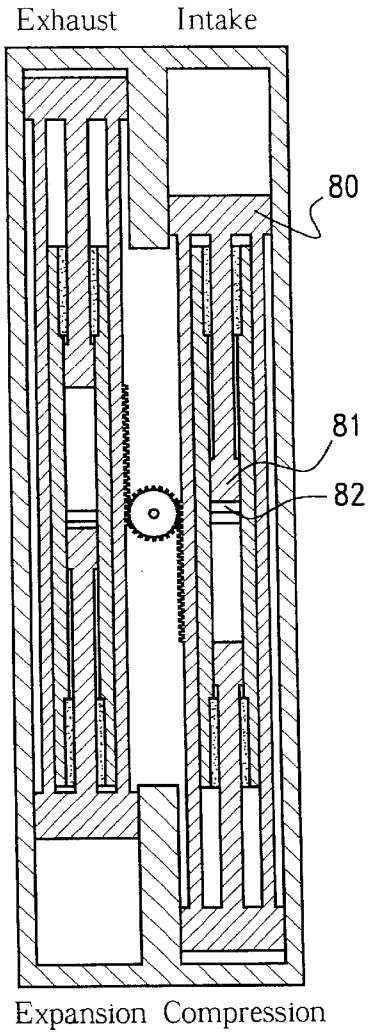
Figure 8A:
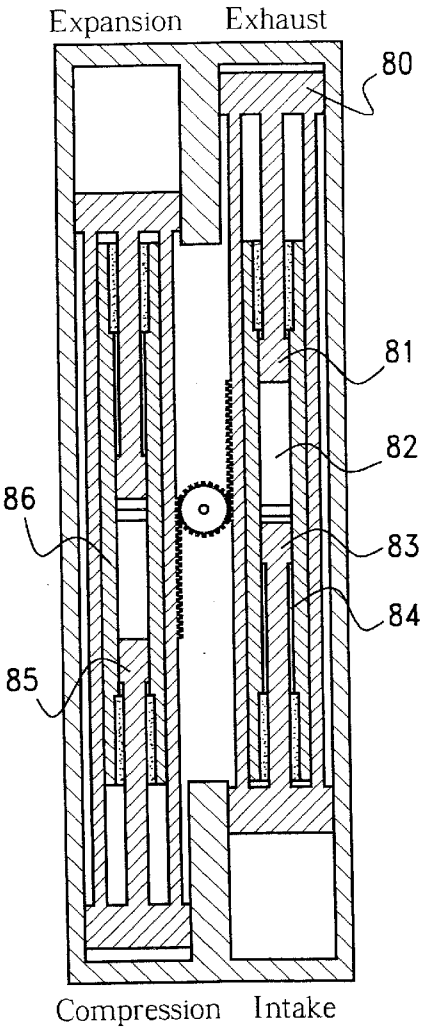

8A–8D respectively show the four positions or strokes in the four-stroke cycle. FIG. 8A and FIG. 8B will be used to explain the one significant difference from the method Of operation described for the single, dual piston assembly engine operating in two-stroke mode. Since a four-stroke cycle engine has two more strokes (the exhaust and intake strokes) than the two-stroke cycle engine to produce a power (or expansion) stroke, each pumping cylinder must go through an additional fill stroke and a discharge back to low pressure stroke, before it can experience a fill and power stroke. FIG. 8A shows combustion piston 80 just completing its exhaust of spent combustion gases (exhaust stroke). During this exhaust stroke, pumping piston 81 has just completed a fill of pumping cylinder 82 (fill stroke). But because the next stroke of combustion piston 80 is an air charge air intake stroke (FIG. 8B), the fluid intake valve for pumping cylinder 82 (not shown) must stay full open to allow discharge of fluid back to low pressure. The air compression and fluid intake stroke (FIG. 8C) and the combustion gas expansion and fluid power stroke (FIG. 8D) are identical to the like strokes of the two-stroke engine configuration previously described and, therefore, their operation is not repeated here.

The two extra fluid pumping strokes described above for four stroke operation can be eliminated by removing two (of the four) pumping pistons and pumping cylinders. For example, referring to FIG. 8, if pumping piston 83 and pumping cylinder 84 and pumping piston 85 and pumping cylinder 86 were eliminated, the remaining two sets of pumping pistons and pumping cylinders would have a power stroke on each pumping piston stroke to its BDC position. This configuration could also operate in a two-stroke mode, but the remaining pumping cylinders must be doubled in flow capacity (by doubling the pumping piston and pumping chamber cross sectional area) to deliver the output power of two combustion events for each stroke to its BDC position. The primary disadvantage of this embodiment of the invention is that additional gas expansion forces would have to be transferred through the gear to the appropriate pumping piston when a combustion piston without its own axial pumping piston experienced its expansion stroke.

Figure 9:
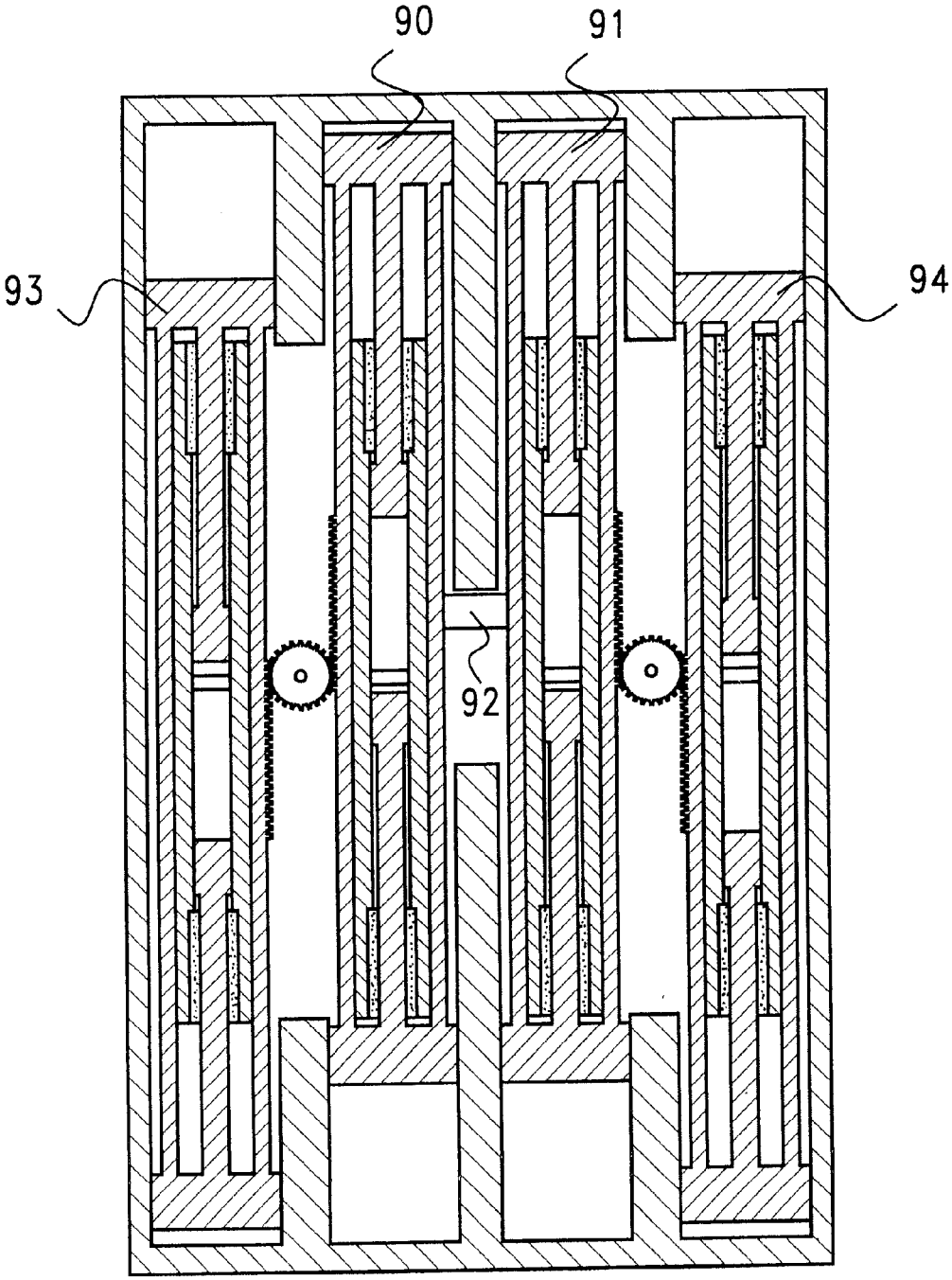
FIG. 9 is a cross-sectional view of yet another embodiment of the present invention which includes four dual piston assemblies arranged in parallel with the synchronization gearing connecting cages of paired dual piston assemblies and a rigid connector connecting the two innermost dual piston assemblies.

FIG. 9 shows another embodiment as an eight-cylinder, free-piston engine, perfectly balanced for mass and moments. While this embodiment can be used in either a two-stroke or a four-stroke cycle operation, the four-stroke operation is especially attractive. To synchronize the movement of the two center dual piston assemblies 90 and 91 and thus the two external dual piston assemblies 93 and 94, a synchronization attachment 92 is used. Dual piston assemblies 90 and 91 and dual piston assemblies 93 and 94 move reciprocally together. All other operational descriptions as previously presented for two-stroke or four-stroke apply. Alternatively, the two geared-together assemblies could be synchronized electronically, but with more control complexity.

Figure 10:
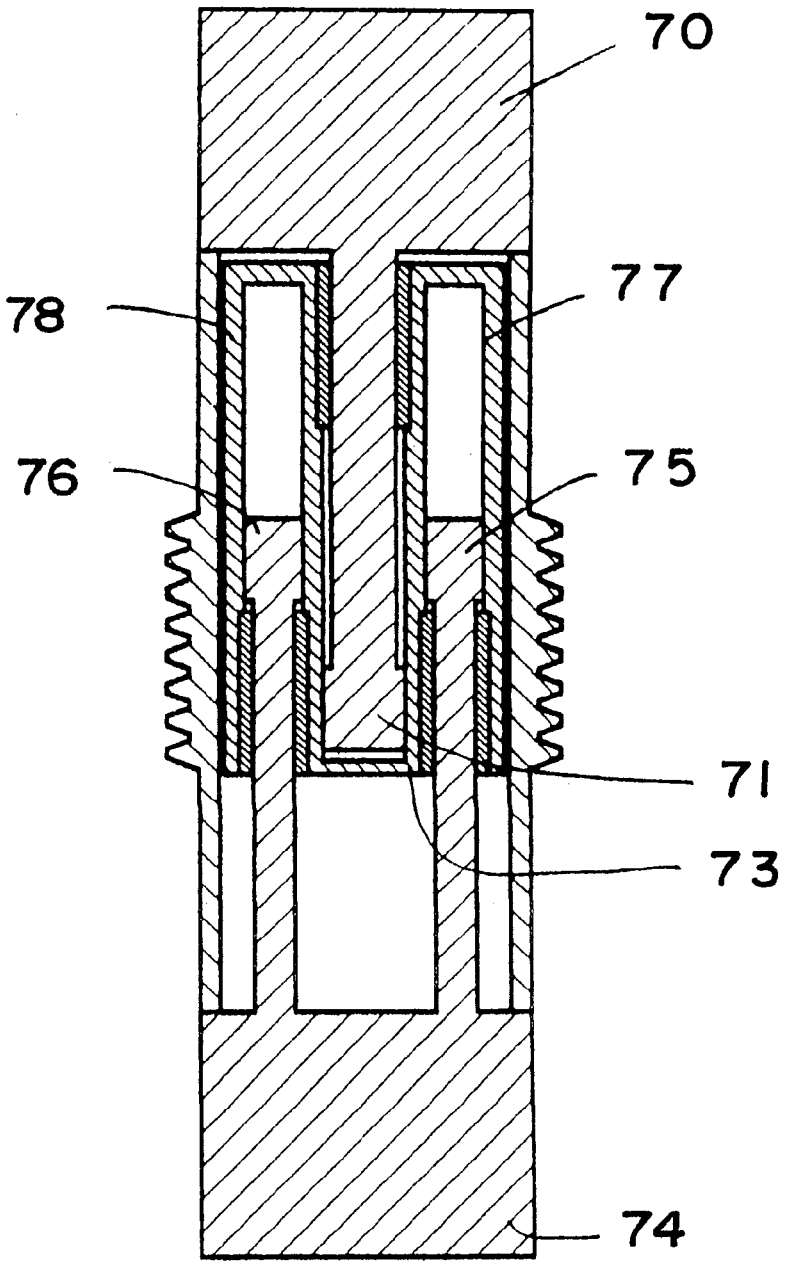
FIG. 10 is a cross-sectional view of a single dual piston assembly of yet another embodiment of the present invention wherein one combustion piston carries two pumping pistons and the other combustion piston of the assembly carries a single pumping piston.

FIG. 10 shows yet another embodiment of the dual piston assembly of the present invention. In this embodiment combustion piston 70 and pumping piston 71 are axially attached, with pumping cylinder 73 also axially aligned with pumping piston 71. Combustion piston 74 has attached two pumping pistons 75 and 76, each centered along a centerline of the combustion piston circular cross section and equally inset from the piston outer diameter to achieve a balanced net force on the combustion piston. Pumping pistons 75 and 76 reciprocate within pumping cylinders 77 and 78. The combined cross sectional area of pumping pistons 75 and 76 must equal the cross sectional area of pumping piston 71. Operational characteristics for two or four-stroke operation are as previously described. A more compact configuration is achieved with the side-by-side pumping pistons, but at the expense of some additional complexity.

Figure 11:
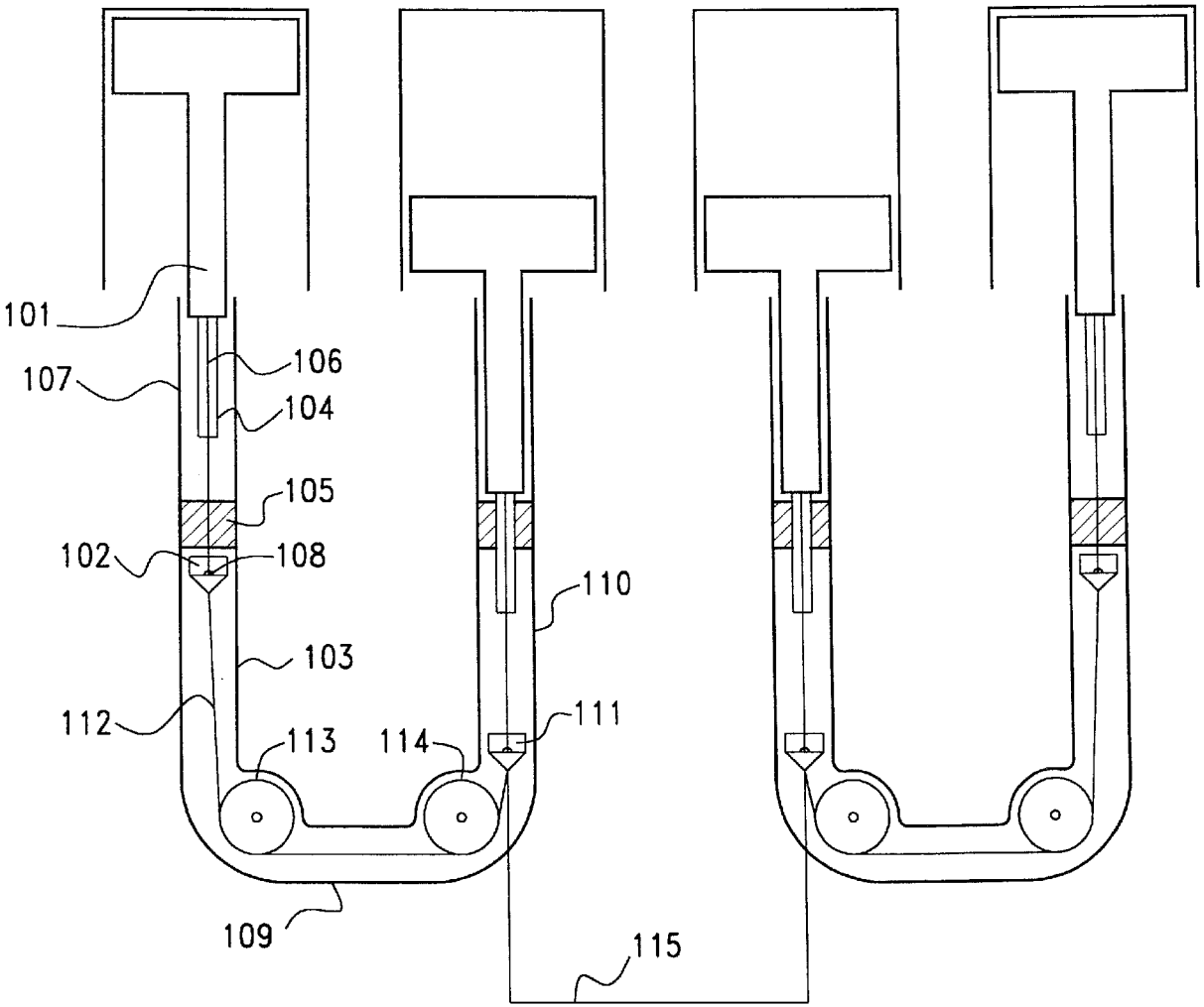
FIG. 11 is a schematic view of yet another embodiment of the engine of the present invention with four combustion cylinders arranged in parallel and a shuttle piston fixed to each of the pumping pistons with a flexible connector connecting the shuffle pistons associated with paired combustion cylinders.

FIG. 11 shows an alternate embodiment that attaches two single piston assemblies by a hydromechanical, flexible linkage. The primary advantage of this embodiment is that the two single piston assemblies may be placed in various locations relative to each other to allow better packaging or balance. The configuration of FIG. 11 provides a side-by-side location for conventional, in-line packaging and mechanical balance. Combustion piston and pumping pistons may be arranged as previously described.

In the embodiment of FIG. 11 an axial pumping piston 101 of the single piston assembly is attached axially to a fluid shuttle piston 102 which reciprocates in shuttle cylinder 103. Pumping piston 101 is attached to shuttle piston 102 by hollow connecting rod 104 which reciprocates through sealing block 105. The hollow center 106 of connecting rod 104 has fluid contact with fluid in pumping cylinder 107. A check valve 108 allows fluid flow only to shuttle cylinder 103 from the hollow center of connecting rod 104. Shuttle cylinder 103 is further attached by transfer tube 109 to shuttle cylinder 110, wherein fluid shuttle piston 111 reciprocates. Shuttle cylinder 110 and shuttle piston 111 being like parts of the second single piston assembly. Shuttle piston 102 is further connected to shuttle piston 111 by a flexible mechanical means which can resist high tension forces, such as chain 112. Appropriate guiding means are used to direct the movement of the flexible mechanical means, such as sprockets 113 and 114. The fluid within shuttle cylinder 103, transfer tube 109 and shuttle cylinder 110 (between shuttle pistons 102 and 111) is replenished (as some leakage inevitably occurs) and is kept pressurized by fluid from pumping cylinder 107 through check valve 108. Pressurized fluid keeps chain 112 in tension, and chain 112 restricts the fluid volume. The fluidlchain assembly acts as a flexible, fixed-length rod, and functions as cage 19 of FIG. 2. Hence, this assembly is hydro-mechanical, with a flexible linkage, and the thus connected two single piston assemblies function as the dual piston assembly of the present invention and can operate with all the features previously described, including a two-stroke cycle with a single dual piston assembly, and a four-stroke cycle with two (or more) dual piston assemblies.

FIG. 11 also shows a mechanical linkage 115 which can be used to tie two dual piston assemblies together to allow four-stroke, mass and moment balanced operation. The two dual piston assemblies could also be electronically linked as previously described for the "cage" embodiments.

Figure 12:
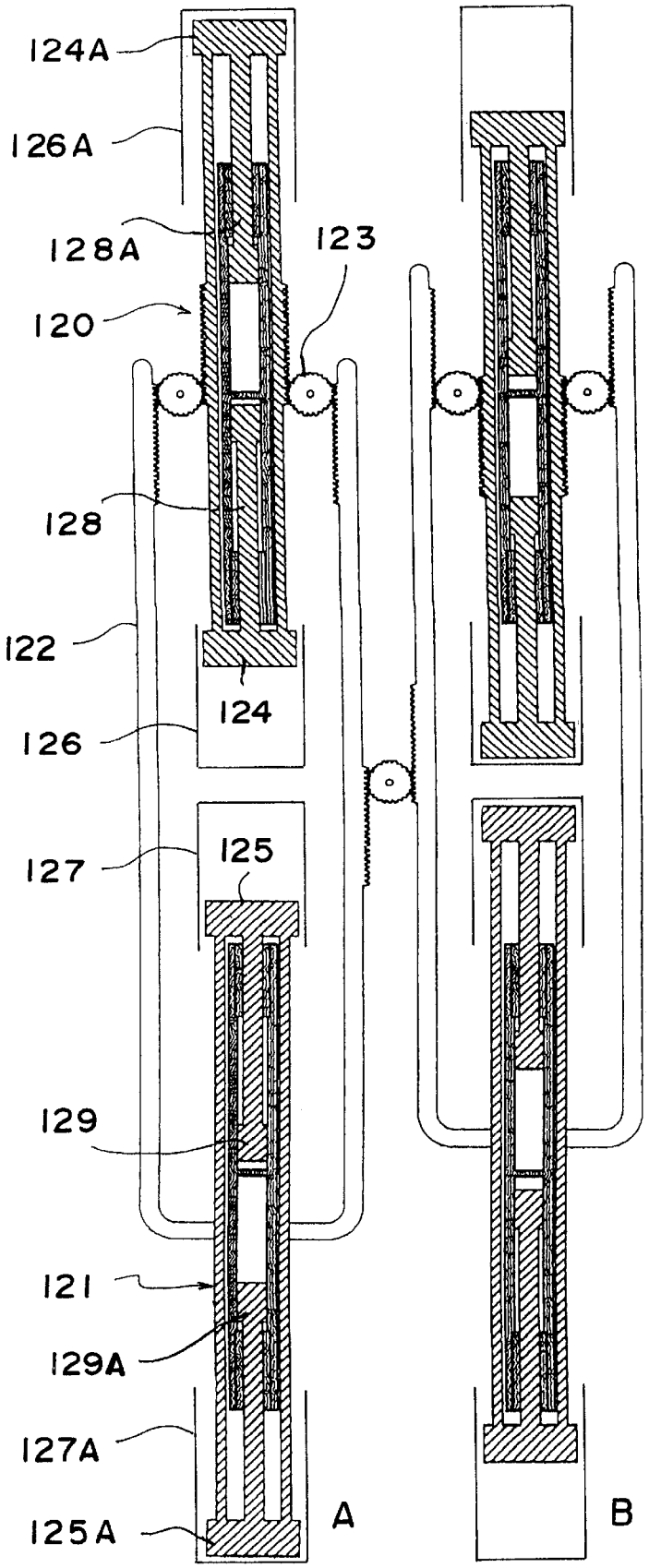
FIG. 12 is a schematic view of another embodiment of the free-piston engine according to the present invention having four dual piston assemblies which are axially paired, with the axially arranged pairs in parallel and connected for synchronized motion.

FIG. 12 shows an alternate embodiment of the "four cylinder," dual piston assembly engine of FIG. 8. FIG. 12 shows two twin, dual piston assemblies A and B. Referring to a single twin, dual piston assembly A, the engine can be run in two-stroke cycle or four-stroke cycle operation as previously described, with the assembly A, mechanically balanced (as with the embodiment of FIG. 8) and, unlike the embodiment of FIG. 8, assembly A is also moment balanced. In the two-stroke cycle mode of operation, assembly A is also "combustion forces balanced," Assembly A can also be mechanically attached to assembly B (as in FIG. 9, attaching two FIG. 8 assemblies) or geared together (as shown) to allow four-stroke, combustion-forces balanced operation. A disadvantage in some applications of the embodiment of FIG. 12 is the significantly increased length of the complete engine.

Assembly A will be used to further describe the unique (over FIG. 8 and previous embodiments) features of this embodiment, i.e., the balancing of moment and combustion forces, operating in the two-stroke mode. Combustion pistons 124, 124A reciprocate within cylinders 126, 126A, respectively, and are fixed together to form a dual piston assembly 120. Combustion pistons 124, 124A carry, fixed thereto, pumping pistons 128, 128A, respectively. Likewise, combustion pistons 125, 125A reciprocate within cylinders 127, 127A, respectively, and are fixed together to form a dual piston assembly 121. Combustion pistons 125, 125A carry, fixed thereto, pumping pistons 129, 129A, respectively. Dual piston assemblies 120 and 121 are synchronized by outer cage 122 through gears 123. Assembly 121 plus outer cage 122 must be of the same mass as assembly 120. As assembly 120 moves from its outer TDC position to its inner TDC position, assembly 121 moves from its outer TDC position to its inner TDC position. At the inner TDC position, both inner combustion piston 124 of assembly 120 and the inner combustion piston 125 of assembly 121 have completed the compression stroke, combustion begins and the expansion stroke follows (as previously described). All forces are balanced within the engine structure.

Figure 13:
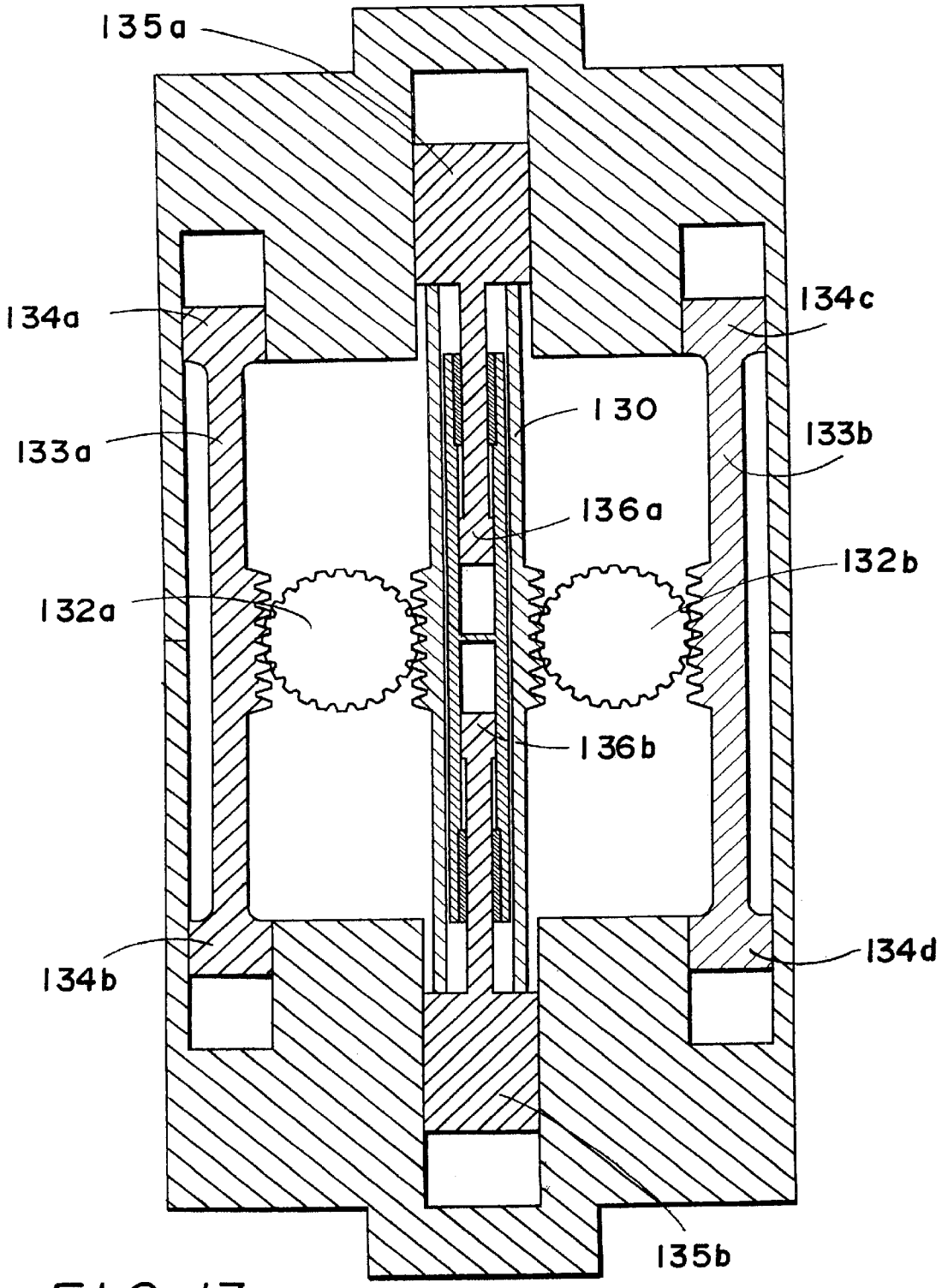
FIG. 13 is a schematic view of another embodiment of the free-piston engine according to the present invention having three dual piston assemblies in parallel.

A modification of the embodiment of FIG. 7 shown in FIG. 13 incorporates dual piston assemblies 133*a* and 133*b* in place of balance masses 63*a* and 63*b* (of FIG. 7), with each combustion piston 134*a*, 134*b*, 134*c* and 134*d* having one-half the area (to give one-half the displacement volume) of the combustion pistons 135*a* and 135*b* of the central dual piston assembly 130. In addition to the continued mechanical balance, this six-cylinder modification of the embodiment of FIG. 7 can be two-stroke or four-stroke operated, with moment and combustion forces balance options as described for the embodiment of FIG. 12 and operates as previously described. FIG. 13 shows dual piston assemblies 133*a* and 133*b* without pumping pistons to reduce cost. The expansion work of combustion pistons 134*a*, 134*b* 134*c* and 134*d* is transferred through synchronization means 132*a* or 132*b* as appropriate to the central dual piston assembly 130 and extracted by pumping pistons 136*a* or 136*b* as appropriate and as previously described. Dual piston assemblies 133*a* and 133*b* could be modified to include pumping pistons (not shown) and would operate as previously described to reduce the forces that would be required to be transferred through synchronization means 132*a* and 132*b*.

In yet another embodiment, the present invention provides a method for repeatable fuel and combustion control, which provides additional time for electronic and mechanical response of the late closing of the fluid intake valve (valve 24*a* or 24 24*b*, as appropriate—FIG. 3). The method of operation previously described with reference to FIGS. 2 and 3 still applies except as will be described here, again with reference to FIGS. 2 and 3. With this alternative method of control, the appropriate late intake valve (valve 24*a* or 24*b* as appropriate) closing position, i.e., appropriate to extract the available energy while leaving sufficient energy to insure the appropriate next TDC assembly position, is determined for each combustion event based on fuel quantity provided/commanded, hydraulic pressure and "expected" cycle efficiency (from tables or algorithms of engine operational characteristics such as friction and heat losses). An optional, adaptive learning adjustment of the "determination" of the appropriate late intake valve closing position is provided based on one or more of the following or similar resultant assembly energy determining means, for each power stroke: (1) velocity of the assembly at select positions (comparing actual to expected) based on signals from position sensor 31, (2) stoppage position of the dual piston assembly (compared to the expected stoppage position) based on signals from position sensor 31, and (3) opposite combustion cylinder pressure at or near assembly stoppage, but before initiation of combustion, based on signals from a cylinder pressure transducer (not shown).

The invention may be embodied in other specific forms without departing from the spirit or essential characteristics thereof The present embodiments are therefore to be considered in all respects as illustrative and not restrictive, the scope of the invention being indicated by the appended claims rather than by the foregoing description, and all changes which come within the meaning-and range of equivalency of the claims are therefore intended to be embraced therein.

I claim:

1. A free-piston engine having at least one engine unit comprising:

a pair of axially opposed combustion cylinders;

a pair of free-floating combustion pistons respectively mounted in said combustion cylinders for reciprocating linear motion therein, responsive to successive combustion events within said combustion cylinders;

a pumping piston extending from and fixed to each of said pair of combustion pistons;

a pair of axially aligned hydraulic cylinders located between said pair of combustion cylinders and respectively receiving said pumping pistons for reciprocating linear motion therein;

a cage rigidly connecting said pair of combustion pistons and surrounding said hydraulic cylinders and pumping pistons to form a reciprocating dual piston assembly which reciprocates as a single unit comprising said pair of combustion pistons, said pumping pistons and said cage; and ports in each of said hydraulic cylinders for admitting fluid at a first pressure and discharging fluid at a second pressure higher than the first pressure.

2. A free-piston engine according to claim 1 wherein said hydraulic cylinders are rigidly connected.

3. A free-piston engine according to claim 1 wherein said combustion cylinders are located relative to said rigidly connected combustion pistons so that when one of said pair of combustion pistons is at top dead center, the other of said pair of combustion pistons is at bottom dead center.

4. A free-piston engine according to claim 1 further comprising a bushing surrounding and guiding a rod connecting a combustion piston with a pumping piston and wherein said combustion piston is ringless.

5. A free-piston engine according to claim 1 further comprising position indicators on said cage, position sensors for reading said position indicators and an electronic control unit for determining position of said cage.

6. A free-piston engine according to claim 1 comprising at least two of said engine units and synchronization means for connecting the cages of at least two of said dual piston assemblies to provide said dual piston assemblies with synchronized parallel movement in opposite directions.

7. A free-piston engine according to claim 6, wherein said synchronization means comprises a rack on each of said cages of said two dual piston assemblies and a pinion located between and engaged by each of said racks.

8. A method of operating a free-piston engine having at least one engine unit, the engine unit including a pair of axially opposed combustion cylinders respectively housing free-floating combustion pistons therein, wherein each combustion piston has at least one pumping piston fixed thereto and mounted in a hydraulic cylinder for reciprocating linear motion therein and wherein the combustion pistons are fixed together and reciprocate in tandem as a dual piston assembly, said method comprising:

drawing a fluid at a low pressure, through a low pressure fluid intake valve, into the hydraulic cylinders as the pumping pistons travel from BDC to TDC and discharging the fluid at a high pressure, higher than the low pressure, as the pumping pistons travel from TDC to BDC;

reading position indicators on the dual piston assembly to generate position signals for a power stroke in one direction;

measuring said high pressure and said low pressure and generating pressure signals representative of the measured pressures;

determining, on the basis of said position signals and said pressure signals, position for closing the low pressure fluid intake valve in the same stroke, to cause the dual piston assembly to stop at the commanded stoppage position and to thereby extract hydraulic power and achieve the target compression ratio of the opposite combustion piston in real time, in the same stroke.

9. A method according to claim 8 wherein the stoppage position is achieved by allowing the low pressure fluid intake valve to remain open through completion of filling through it of a hydraulic cylinder and to close the low pressure fluid valve at a position during discharge through it, back to low pressure, of 20% to 100% of the filled volume of the hydraulic cylinder.

10. A method of operating a free-piston engine having at least one engine unit including a pair of axially opposed combustion cylinders respectively housing free-floating combustion pistons therein, wherein each combustion piston has at least one pumping piston fixed thereto and mounted in a hydraulic cylinder for reciprocating linear motion therein and wherein the paired combustion pistons are fixed together and reciprocate in tandem as a dual piston assembly, said method comprising:

drawing a fluid at a low pressure, through a low pressure fluid intake valve, into the hydraulic cylinders as the pumping pistons travel from BDC to TDC and discharging the fluid at a high pressure, higher than the low pressure, as the pumping pistons travel from TDC to BDC;

reading position indicators, located on the dual piston assembly at plural positions of the dual piston assembly, in a power stroke of a given cycle to generate position signals;

determining energy produced by a single combustion event in said given cycle, as a function of the velocity and acceleration of the dual piston assembly, on the basis of the position signals;

measuring said high pressure and said low pressure and generating pressure signals representative of the measured pressures;

on the basis of the determined energy and said pressure signals, determining a position for closing the low pressure fluid intake valve for attaining a target compression ratio for a compression stroke in a cycle subsequent to said given cycle; and in said given cycle, closing the low pressure fluid intake valve during discharge back to low pressure to cause the dual piston assembly to stop at the desired stoppage position to thereby achieve the target compression ratio in real time.

11. A method according to claim 8 wherein a target compression ratio is commanded for each cycle and the low pressure fluid intake valve is closed during discharge back to low pressure to achieve the target compression ratio.

12. A method according to claim 8 further comprising:

determining at least one of engine operating parameters including fuel supply rate and said high pressure;

establishing a range of stoppage positions for the closing of the low pressure fluid intake valve, on the basis of the determined engine operating parameters; and shutting the engine off when a detected stoppage position is outside of the established range of stoppage positions.

13. A free-piston engine according to claim 1 further comprising at least one fluid intake valve for controlling the admission of fluid to one of said hydraulic cylinders, said fluid intake valve comprising:

a valve member including a cupped head having a peripheral sealing surface, opposing concave and convex surfaces, and an integral guide stem extending from said convex surface;

a guide member having an axial bore receiving said guide stem and providing for axial reciprocating movement of said valve member relative thereto between open and closed positions;

a spring for biasing said valve member toward said closed position where the sealing surface of the head of the valve member seals against a valve seat;

an outlet port in fluid communication with said one hydraulic cylinder;

an inlet port surrounded by said valve seat; and a reciprocable pin mounted coaxially within said inlet port for reciprocating movement between a retracted position and an extended position wherein said pin is in contact with said concave surface of said cupped head, holding said valve member in said open position.

14. A free-piston engine according to claim 1 further comprising at least one high pressure fluid discharge valve for controlling the discharge of fluid from one of said hydraulic cylinders, said fluid discharge valve comprising:

a valve member including a cupped head having a peripheral sealing surface, opposing concave and convex surfaces, and an integral guide stem extending from said convex surface;

a guide member having an axial bore receiving said guide stem and providing for axial reciprocating movement of said valve member relative thereto between open and closed positions;

a spring for biasing said valve member toward said closed position where the sealing surface of the head of the valve member seals against a valve seat;

an outlet in fluid communication with said one hydraulic cylinder and surrounded by said valve seat; and a fluid connector passage connecting said one cylinder with said axial bore so that, as fluid pressure within said one cylinder is increased as the pumping piston mounted therein approaches bottom dead center, the increased pressure operates on said guide stem to force said valve member into said closed position.

15. A free-piston engine according to claim 14 further comprising a fluid accumulator connected to said outlet.

16. A free-piston engine according to claim 15 further comprising a gas-filled bladder within said accumulator.

17. A free-piston engine according to claim 14 wherein said outlet is shut off by said pumping piston as said pumping piston approaches bottom dead center thereby creating a trapped fluid volume wherein the rising pressure creates a braking force on said pumping piston.

18. A free-piston engine according to claim 1 further comprising impact pads mounted on said cage for limiting movement of said dual piston assembly into said combustion cylinders.

19. A free-piston engine according to claim 1 further comprising balancing members mounted on said opposing sides of and connected to said dual piston assembly for reciprocating motion in a direction opposite to the direction of motion of said dual piston assembly.

20. A free-piston engine according to claim 1 comprising first through fourth of said engine units arranged in line and including, respectively, first through fourth dual piston assemblies, first synchronization means for connecting the cages of first and second dual piston assemblies to provide the first and second dual piston assemblies with synchronized parallel movement in opposite directions, second synchronization means for connecting the cages of the third and fourth dual piston assemblies to provide the third and fourth dual piston assemblies with synchronized parallel movement in opposite directions, and a connector rigidly connecting together the cages of the second and third dual piston assemblies for reciprocating motion in tandem.

21. A free-piston engine according to claim 20 wherein said first synchronization means comprises a rack on the cage of each of said first and second dual piston assemblies and a first pinion located between and engaged by the racks on the first and second dual piston assemblies, and wherein said second synchronization means comprises a rack on the cages of each of the third and fourth dual piston assemblies and a second pinion located between and engaged by the racks of the cages of the third and fourth dual piston assembles.

22. A free-piston engine according to claim 1 comprising first and second pumping pistons extending from one of said combustion pistons and a third pumping piston extending from the other combustion piston and first, second and third hydraulic cylinders respectively receiving the first, second and third pumping pistons, said first and second pumping pistons being centered on a centerline of the circular cross-section of said one combustion piston and having a combined cross-sectional area equal to the cross-sectional area of said third pumping piston.

23. A free-piston engine comprising:

a pair of parallel side-by-side combustion cylinders;

a free-floating combustion piston mounted in each of said combustion cylinders for reciprocating linear motion therein, responsive to successive combustion events within said combustion cylinders;

at least one pumping piston extending from and fixed to each of said combustion pistons;

a hydraulic cylinder receiving each of said pumping pistons for reciprocating motion therein;

a shuttle cylinder axially aligned with and in fluid communication with each of said hydraulic cylinders and a shuttle piston mounted in each shuttle cylinder for reciprocating motion therein;

connectors for rigidly and axially connecting each shuttle piston to a pumping piston;

a transfer tube providing fluid communication respectively between said shuttle cylinders; and a flexible linkage passing through said transfer tube and connecting the shuttle pistons.

24. A free-piston engine comprising:

four parallel side-by-side combustion cylinders;

a free-floating combustion piston mounted in each of said combustion cylinders for reciprocating linear motion therein, responsive to successive combustion events within said combustion cylinders;

at least one pumping piston extending from and fixed to each of said combustion pistons;

a hydraulic cylinder receiving each of said pumping pistons for reciprocating motion therein;

a shuttle cylinder axially aligned with and in fluid communication with each of said hydraulic cylinders and a shuttle piston mounted in each shuttle cylinder for reciprocating motion therein;

connectors for rigidly and axially connecting a shuttle piston to each pumping piston;

transfer tubes providing fluid communication respectively between first and second shuttle cylinders and between third and fourth shuttle cylinders;

flexible linkages passing through respective transfer tubes and connecting, respectively the shuttle pistons in the first and second shuttle cylinders and the shuttle pistons in the third and fourth shuttle cylinders; and a linkage connecting together the shuttle pistons in the second and third shuttle cylinders for movement together in tandem along with associated pumping pistons and combustion pistons.

25. A free-piston engine according to claim 24 wherein said combustion cylinders are arranged in-line.

26. A free-piston engine according to claim 23 wherein said connectors are hollow tubes and wherein fluid communicates between a shuttle cylinder and a hydraulic cylinder through said connector and a central passageway in each shuttle piston, and further comprising a check valve in the central passageway of each shuttle piston allowing fluid flow only in the direction of from the hydraulic cylinder to the shuttle cylinder.

27. A free-piston engine according to claim 24 wherein said connectors are hollow tubes and wherein fluid communicates between a shuttle cylinder and a hydraulic cylinder through said connector and a central passageway in each shuttle piston, and further comprising a check valve in the central passageway of each shuttle piston allowing fluid flow only in the direction of from the hydraulic cylinder to the shuttle cylinder.

28. A free-piston engine according to claim 1 comprising at least a pair of axially aligned dual piston assemblies; and an outer cage rigidly fixed to a cage of one of the dual piston assemblies and connected through synchronization means to the other dual piston assembly in said aligned pair to provide the dual piston assemblies with synchronized axial movement in opposite directions.

29. A free-piston engine according to claim 1 comprising four of said dual piston assemblies, including axially aligned first and second dual piston assemblies and axially aligned third and fourth dual piston assemblies, the first and second assemblies being arranged parallel to the third and fourth assemblies;

an outer cage rigidly fixed to a cage of one of the dual piston assemblies in each axially aligned pair and connected through first synchronization means to the other of the dual piston assembly in said aligned pair for providing the dual piston assemblies with synchronized axial movement in opposite directions; and second synchronization means connecting said outer cages for synchronized parallel motion in opposite directions.

30. A free-piston engine according to claim 29 wherein said second synchronization means includes a rack on each of said outer cages and a pinion arranged between and engaged by each of said racks.

31. A method of operating a free-piston engine having at least one engine unit, the engine unit including a pair of axially opposed combustion cylinders respectively housing free-floating combustion pistons therein, wherein each combustion piston has at least one pumping piston fixed thereto and mounted in a hydraulic cylinder for reciprocating linear motion therein and wherein the combustion pistons are fixed together and reciprocate in tandem as a dual piston assembly, said method comprising:

drawing a fluid at a low pressure, through a low pressure fluid intake valve, into the hydraulic cylinders as the pumping pistons travel from BDC to TDC and discharging the fluid at a high pressure, higher than the low pressure, as the pumping pistons travel from TDC to BDC;

determining fuel energy commanded for a power stroke in one direction;

measuring said high pressure and said low pressure and generating pressure signals representative of the measured pressures;

measuring engine temperature and generating temperature signals representative of the measured temperature;

determining expected cycle efficiency from tables or algorithms, on the basis of the temperature signals and the determined fuel energy commanded; and determining, on the basis of said fuel energy commanded, said pressure signals and said expected cycle efficiency, a position for closing the low pressure fluid intake valve in the same stroke, to cause the dual piston assembly to stop at the commanded stoppage position and to thereby extract hydraulic power and achieve the target compression ratio of the opposite combustion piston in the same stroke.

32. A method according to claim 31 wherein the position for closing said low pressure fluid intake valve is adjusted based on the measured available energy resultant from each power stroke.

33. A method according to claim 32 wherein said measured available energy is determined based on reading position indicators on the dual piston assembly to generate position signals for said power stroke and computing the velocity of said assembly.

34. A method according to claim 32 wherein said measured available energy is determined based on reading position indicators on the dual piston assembly to generate position signals for said power stroke and a measured stoppage position of said assembly.

35. A method according to claim 32 wherein said measured available energy is determined based on reading position indicators on the dual piston assembly to generate position signals for said power stroke and the measured opposite combustion cylinder pressure at or near said assembly stoppage but before initiation of combustion.

36. A method of operating a free-piston engine having at least two engine units, each engine unit including two axially opposed combustion cylinders respectively housing free-floating combustion pistons therein, wherein each combustion piston has at least one pumping piston fixed thereto and mounted in a hydraulic cylinder for reciprocating linear motion therein, wherein the two combustion pistons are fixed together and reciprocate in tandem as a dual piston assembly and wherein the two combustion pistons of a first engine unit are connected to the two combustion pistons of a second engine unit for synchronized movement in opposite directions, said method comprising:

drawing a fluid at a low pressure, through a low pressure fluid intake valve, into the hydraulic cylinder of a first pumping piston during an exhaust stroke of a first combustion piston, fixed to said first pumping piston;

drawing an air charge into the combustion cylinder housing of said first combustion piston by an intake stroke of said first combustion piston, while keeping open said low pressure fluid intake valve and discharging fluid from the hydraulic cylinder of said first pumping piston at the low pressure;

compressing the air charge by a compression stroke of said first combustion piston while drawing fluid back into the hydraulic cylinder of the first pumping piston;

closing the low pressure fluid intake valve and discharging fluid from the hydraulic cylinder of the first pumping piston at a high pressure, higher than the low pressure, while the first combustion piston goes through a power stroke;

reading position indicators on a dual piston assembly including said first combustion piston to generate position signals for one of said strokes in one direction; and determining, on the basis of the position signals, a position for closing the low pressure fluid intake valve in the same cycle to extract hydraulic power and achieve a target compression ratio in real time, in the compression stroke of a second combustion piston, paired with the first combustion piston.

37. A method of operating a free-piston engine having at least two engine units, each engine unit including two axially opposed combustion cylinders respectively housing free-floating combustion pistons therein, wherein at least two of said combustion pistons have at least one pumping piston fixed thereto and mounted in a hydraulic cylinder for reciprocating linear motion therein, wherein the two combustion pistons are fixed together and reciprocate in tandem as a dual piston assembly and wherein the two combustion pistons of a first engine unit are connected to the two combustion pistons of a second engine unit for synchronized movement in opposite directions, said method comprising:

drawing a fluid at a low pressure, through a low pressure fluid intake valve, into the hydraulic cylinder of a first pumping piston during a first stroke to top dead center of a first combustion piston, fixed to said first pumping piston;

closing the low pressure fluid intake valve and discharging fluid from the hydraulic cylinder of the first pumping piston at a high pressure, higher than the low pressure, while the first combustion piston goes through a power stroke;

drawing a fluid at low pressure, through a low pressure fluid intake valve, into the hydraulic cylinder of said first pumping piston during a second stroke to top dead center of said first combustion piston;

closing the low pressure fluid intake valve and discharging fluid from the hydraulic cylinder of said first pumping piston at a high pressure, higher than the low pressure, while a second combustion piston, fixed to said first combustion piston in a dual piston assembly, goes through a power stroke;

reading position indicators on a dual piston assembly including said first combustion piston to generate position signals for one of said strokes in one direction; and determining, on the basis of the position signals, a position for closing the low pressure fluid intake valve in the same cycle to extract hydraulic power and achieve a target compression ratio in real time, in the compression stroke of said second combustion piston.

38. A free-piston engine according to claim 1 comprising three of said engine units with first, second and third dual piston assemblies arranged in line and further comprising:

synchronization means for moving the first and third dual piston assemblies in a direction opposite direction of movement of the second dual piston assembly; and wherein the second dual piston assembly has a mass twice that of the individual first and third dual piston assemblies; and wherein the combustion pistons of the second dual piston assembly have a cross-sectional area twice that of the cross-sectional area of the combustion pistons of the first and third dual piston assemblies.

39. A free piston engine according to claim 38 wherein said first and third dual piston assemblies do not include pumping pistons.

* * * * *